US009128437B2

(12) United States Patent
Sugiura

(10) Patent No.: US 9,128,437 B2
(45) Date of Patent: Sep. 8, 2015

(54) IMAGE RECORDING APPARATUS AND COMPUTER READABLE MEDIUM

(71) Applicant: Shinta Sugiura, Nagoya (JP)

(72) Inventor: Shinta Sugiura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/038,902

(22) Filed: Sep. 27, 2013

(65) Prior Publication Data

US 2014/0092152 A1 Apr. 3, 2014

(30) Foreign Application Priority Data

Sep. 28, 2012 (JP) ..... 2012-218156

(51) Int. Cl.
*B41J 2/165* (2006.01)
*G03G 15/00* (2006.01)

(52) U.S. Cl.
CPC ..... *G03G 15/50* (2013.01); *G03G 15/553* (2013.01); *G03G 15/6502* (2013.01)

(58) Field of Classification Search
CPC .. B41J 29/38; G03G 15/5095; G03G 15/6508
USPC ..... 347/14, 16, 23
See application file for complete search history.

(56) References Cited

U.S. PATENT DOCUMENTS 4,860,055 A * 8/1989 Ohira et al. ..... 399/81
5,036,361 A * 7/1991 Filion et al. ..... 399/81
6,978,114 B2 * 12/2005 Okamoto et al. ..... 399/389
7,845,757 B2 * 12/2010 Nishiyama ..... 347/23

FOREIGN PATENT DOCUMENTS

JP 2002-337433 A 11/2002

* cited by examiner

*Primary Examiner* — Alessandro Amari
*Assistant Examiner* — Michael Konczal
(74) *Attorney, Agent, or Firm* — Scully, Scott, Murphy & Presser, P.C.

(57) ABSTRACT

A recording unit configured to record an image on a recording medium, medium storages storing same-sized recording media, a conveyance mechanism configured to selectively convey the recording media stored in the medium storages to the recording unit, and a maintenance mechanism are provided. When, at the start of a maintenance period in which the maintenance of the recording unit is performed by the maintenance mechanism, the number of recording media stored in the sender medium storage is smaller than the number of recording media required to record all remaining images onto recording media in accordance with image data and, among the medium storages, there is at least one predetermined remaining number medium storage which is a medium storage storing more recording media than the sender medium storage, one of the at least one of predetermined remaining number medium storage is selected as the sender medium storage, during the maintenance period.

8 Claims, 8 Drawing Sheets

IMAGE RECORDING APPARATUS AND COMPUTER READABLE MEDIUM

CROSS REFERENCE TO RELATED APPLICATION

The present application claims priority from Japanese Patent Application No. 2012-218156, which was filed on Sep. 28, 2012, the disclosure of which is incorporated herein by reference in its entirety.

BACKGROUND OF THE INVENTION

1 Field of the Invention

The present invention relates to an image recording apparatus and a computer readable medium.

2 Description of Related Art

As an image recording apparatus, a color photocopier including a plurality of sheet cassettes supplying sheets (recording media) and a printer (recording unit) printing images onto sheets supplied from the sheet cassettes has been known. In this color photocopier, when the sheets in a sheet cassette run out during the printing, whether there is another sheet cassette containing the sheets of the same size is checked, and the sheets are supplied from the other sheet cassette when there is such a sheet cassette containing the sheets of the same size.

SUMMARY OF THE INVENTION

In the meanwhile, an image recording apparatus which performs the maintenance of the recording unit according to need while image recording onto a recording medium is being conducted by the recording unit has been known. In this image recording apparatus, the image recording onto the recording medium by the recording unit is stopped during the maintenance of the recording unit. Furthermore, when the sheet cassette from which recording media are supplied is switched as in the color photocopier above, the image recording onto the recording medium by the recording unit is also stopped for a predetermined time. As such, the user waiting time is long when the image recording onto the recording medium by the recording unit is frequently stopped.

In consideration of this, an aspect of the present invention is to provide a computer readable medium capable of reducing the user waiting time and a control program of the image recording apparatus.

An image recording apparatus of an embodiment includes: a storage unit configured to store image data; a recording unit configured to record an image on a recording medium in accordance with the image data; a plurality of medium storages configured to store same-sized recording media; a conveyance mechanism configured to selectively convey the recording media stored in the medium storages to the recording unit; a sensor configured to detect the number of recording media stored in each of the medium storages; a maintenance mechanism configured to perform maintenance of the recording unit; and a control device configured to perform: a detection process of detecting the number of recording media stored in at least two of the medium storages based on a result of detection by the sensor; a calculation process of calculating the number of recording media required to record all remaining images on recording media by the recording unit in accordance with the image data; a determination process of determining whether the maintenance of the recording unit is necessary; an image recording process of controlling the conveyance mechanism so that the recording media are conveyed from a sender medium storage which is one of the medium storages and controlling the recording unit so that images in accordance with the image data are recorded on the recording media conveyed to the recording unit by the conveyance mechanism; a maintenance process of controlling the maintenance mechanism so that the maintenance of the recording unit is performed when it is determined in the determination process that the maintenance of the recording unit is necessary; and a switching process of controlling the conveyance mechanism and the recording unit so that the conveyance of the recording media from the sender medium storage to the recording unit and recording of images onto the recording media are not conducted during a maintenance period in which the maintenance of the recording unit is performed by the maintenance mechanism, and, when, at the start of the maintenance period, the number of recording media stored in the sender medium storage detected in the detection process is smaller than the number of recording media calculated in the calculation process and, among the medium storages, there is at least one predetermined remaining number medium storage which is a medium storage storing more recording media than the sender medium storage, controlling the conveyance mechanism to select one of the at least one predetermined remaining number medium storage as the sender medium storage, during the maintenance period.

In addition to the above, an image recording apparatus of the embodiment includes: a storage unit configured to store image data; a recording unit configured to record an image on a recording medium in accordance with the image data; a plurality of medium storages configured to store same-sized recording media; a conveyance mechanism configured to selectively convey the recording media stored in the medium storages to the recording unit; a sensor configured to detect the number of recording media stored in each of the medium storages; a maintenance mechanism configured to perform maintenance of the recording unit; and a control device configured to perform: a detection process of detecting the number of recording media stored in at least two of the medium storages, based on a result of detection by the sensor; a counting process of counting the number of recording media on which images have been recorded by the recording unit in accordance with the image data, from a later one of a timing at which the recording of the images onto the recording media by the recording unit in accordance with the image data starts and a timing at which previous maintenance is performed by the maintenance mechanism; a calculation process of calculating the number of recording media required to record all remaining images on recording media by the recording unit in accordance with the image data; an image recording process of controlling the conveyance mechanism so that recording media are conveyed from a sender medium storage which is one of the medium storages and controls the recording unit so that images are recorded on the recording media conveyed by the conveyance mechanism in accordance with the image data; a maintenance process of controlling the maintenance mechanism so that maintenance of the recording unit is performed when the number of recording media counted in the counting process reaches a predetermined number; and a switching process of controlling the conveyance mechanism so that, when it is determined in the detection process that the number of recording media stored in the sender medium storage is zero, the sender medium storage is switched to one of medium storages in each of which the number of stored recording media is not zero, in a switching period in which the sender medium storage is switched by the conveyance mechanism, the conveyance mechanism and the recording unit being controlled so that the conveyance of recording media from the medium storage to the recording unit and recording of images onto the recording media are not performed, and when a number calculated by subtracting the number of recording media counted in the counting process from the predetermined number is smaller than the number of recording media calculated in the calculation process and the number of recording media detected in the detection process stored in a medium storage which is selected to function as the sender medium storage after the switching period of switching the sender medium storage, the maintenance mechanism is controlled so that the maintenance of the recording unit is performed in the switching period.

In addition to the above, a non-transitory computer readable medium of the embodiment configured to store a program performed by an image recording apparatus includes: a storage unit configured to store image data; a recording unit configured to record an image on a recording medium in accordance with the image data; a plurality of medium storages configured to store same-sized recording media; a conveyance mechanism configured to selectively convey the recording media stored in the medium storages to the recording unit; a sensor configured to detect the number of recording media stored in each of the medium storages; and a maintenance mechanism configured to perform maintenance of the recording unit. The program causes the image recording apparatus to perform: a detection process of detecting the number of recording media stored in at least two of the medium storages based on a result of detection by the sensor; a calculation process of calculating the number of recording media required to record all remaining images on recording media by the recording unit in accordance with the image data; a determination process of determining whether the maintenance of the recording unit is necessary; an image recording process of controlling the conveyance mechanism so that the recording media are conveyed from a sender medium storage which is one of the medium storages and controlling the recording unit so that images in accordance with the image data are recorded on the recording media conveyed to the recording unit by the conveyance mechanism; a maintenance process of controlling the maintenance mechanism so that the maintenance of the recording unit is performed when it is determined in the determination process that the maintenance of the recording unit is necessary; and a switching process of controlling the conveyance mechanism and the recording unit so that the conveyance of the recording media from the sender medium storage to the recording unit and recording of images onto the recording media are not conducted during a maintenance period in which the maintenance of the recording unit is performed by the maintenance mechanism, and, when, at the start of the maintenance period, the number of recording media stored in the sender medium storage detected in the detection process is smaller than the number of recording media calculated in the calculation process and, among the medium storages, there is at least one predetermined remaining number medium storage which is a medium storage storing more recording media than the sender medium storage, controlling the conveyance mechanism to select one of the at least one of predetermined remaining number medium storage as the sender medium storage, during the maintenance period.

In addition to the above, a non-transitory computer readable medium of the embodiment configured to store a program performed by an image recording apparatus includes: a storage unit configured to store image data; a recording unit configured to record an image on a recording medium in accordance with the image data; a plurality of medium storages configured to store same-sized recording media; a conveyance mechanism configured to selectively convey the recording media stored in the medium storages to the recording unit; a sensor configured to detect the number of recording media stored in each of the medium storages; and a maintenance mechanism configured to perform maintenance of the recording unit. The program causes the image recording apparatus to perform: a detection process of detecting the number of recording media stored in at least two the medium storages, based on a result of detection by the sensor; a counting process of counting the number of recording media on which images have been recorded by the recording unit in accordance with the image data, from a later one of a timing at which the recording of the images onto the recording media by the recording unit in accordance with the image data starts and a timing at which previous maintenance is performed by the maintenance mechanism; a calculation process of calculating the number of recording media required to record all remaining images on recording media by the recording unit in accordance with the image data; an image recording process of controlling the conveyance mechanism so that recording media are conveyed from a sender medium storage which is one of the medium storages and controls the recording unit so that images are recorded on the recording media conveyed by the conveyance mechanism in accordance with the image data; a maintenance process of controlling the maintenance mechanism so that maintenance of the recording unit is performed when the number of recording media counted in the counting process reaches a predetermined number; and a switching process of controlling the conveyance mechanism so that, when it is determined in the detection process that the number of recording media stored in the sender medium storage is zero, the sender medium storage is switched to one of medium storages in each of which the number of stored recording media is not zero, in a switching period in which the sender medium storage is switched by the conveyance mechanism, the conveyance mechanism and the recording unit being controlled so that the conveyance of recording media from the medium storage to the recording unit and recording of images onto the recording media are not performed, and when a number calculated by subtracting the number of recording media counted in the counting process from the predetermined number is smaller than the number of recording media calculated in the calculation process and the number of recording media detected in the detection process stored in a medium storage which is selected to function as the sender medium storage after the switching period of switching the sender medium storage, the maintenance mechanism is controlled so that the maintenance of the recording unit is performed in the switching period.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
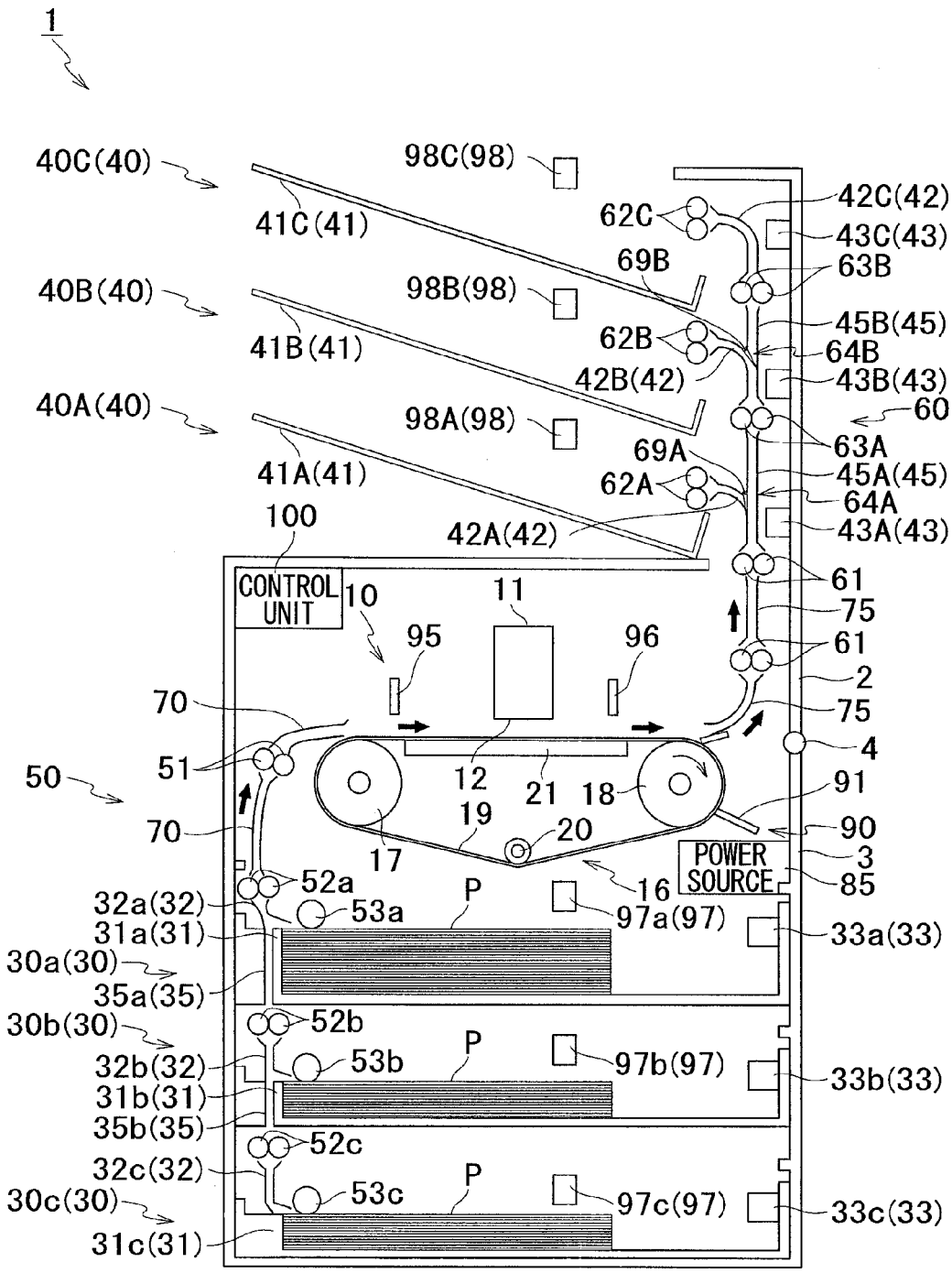
FIG. 1 is a schematic profile showing a mechanical structure of an inkjet printer of First Embodiment.

As a preferred embodiment of the present invention, the following will describe a case where the image recording apparatus is embodied as an inkjet printer, with reference to figures. To begin with, referring to FIG. 1 and FIG. 2, the overall structure of an inkjet printer 1 (hereinafter, printer 1) of First Embodiment will be described. As shown in FIG. 1, the printer 1 includes an upper chassis 2 and a lower chassis 3 both of which are rectangular parallelepiped. The upper chassis 2 is an open-bottom box whereas the lower chassis 3 is an open-top box. As the upper chassis 2 is superposed on the lower chassis 3 so that the openings of the respective chassis are sealed by each other, the space inside the printer 1 is defined. In the space defined by the upper and lower chassis 2 and 3, a conveying path on which sheets P which are recording media are conveyed is formed.

At one lower side, the upper chassis 2 is connected to the lower chassis 3 via a shaft 4 which extends in a direction orthogonal to the plane of the figure. The upper chassis 2 is arranged to be rotatable about the shaft 4 in a direction including a vertical component, with respect to the lower chassis 3. Being rotatable, the upper chassis 2 is switchable between a close position where the upper chassis 2 is close to the lower chassis 3 and a separated position where the upper chassis 2 is far from the lower chassis 3 as compared to the upper chassis 2 at the close position. When the upper chassis 2 is at the separated position, a part of the conveying path is exposed to the outside to secure a working space for user's operations on the conveying path. When the upper chassis 2 is at the separated position and the working space is secured, an operation to resolve jamming becomes possible. The operation to resolve jamming is a user's operation to remove the jammed sheet P from the conveying path.

In addition to the above, as shown in FIG. 1, the printer 1 includes components such as: a recording unit 10 configured to record an image on a sheet P; a plurality of (three in the embodiment) medium storages 30*a* to 30*c* configured to store sheets P to be supplied to the recording unit 10; a plurality of (three in the embodiment) medium supporters 40A to 40C on each of which a sheet P on which an image is recorded by the recording unit 10 is placed; an upstream conveyance mechanism 50 configured to selectively convey the sheets P stored in the medium storages 30*a* to 30*c* to the recording unit 10; a downstream conveyance mechanism 60 configured to selectively convey the sheets P on which images are recorded by the recording unit 10 to the medium supporters 40A to 40C; an upstream main body guide 70; a downstream main body guide 75; a touch panel 81 (see FIG. 2); a power source 85 configured to supply power to the medium storages 30*a* to 30*c* and the medium supporters 40A to 40C; a cleaning unit 90; sheet sensors 95 and 96; and a control unit 100 configured to control the overall operation of the printer 1.

Note that, hereinafter, the lower-case letters "a, b, and c" attached to the reference numbers indicate relevance to the medium storages 30*a*, 30*b*, and 30*c*, respectively. Such lower-case letters are not attached to the reference numbers of matters which are in common with all of the medium storages 30*a*, 30*b*, and 30*c*. Furthermore, the upper-case letters "A, B, and C" attached to the reference numbers indicate relevance to the medium supporters 40A, 40B, and 40C, respectively. Such upper-case letters are not attached to the reference numbers of matters which are in common with all of the medium supporters 40A, 40B, and 40C.

The three medium storages 30 are serially connected to the recording unit 10 in multiple stages. To convey a sheet P stored in the medium storage 30*b* or 30*c*, which is connected to the recording unit 10 as a second or a subsequent stage, to the recording unit 10, the sheet P is conveyed to the recording unit 10 via a medium storage 30 which is on a stage preceding to the sender medium storage 30 from which the sheet P is conveyed. In a similar manner, the three medium supporters 40 are serially connected to the recording unit 10 in multiple stages. To convey a sheet P from the recording unit 10 to the medium supporter 40B or 40C which is connected to the recording unit 10 as a second or a subsequent stage, the sheet P is conveyed to the recording unit 10 via a medium supporter 40 which is a stage preceding to the receiver medium supporter 40 to which the sheet P is conveyed.

The above-described recording unit 10 includes a conveyance belt unit 16 and an inkjet head 11 configured to eject black ink droplets onto a sheet P. The conveyance belt unit 16 includes two belt rollers 17 and 18, a conveyance belt 19, a tension roller 20, and a platen 21. The conveyance belt 19 is an endless belt stretched between the two rollers 17 and 18, and is tensioned by the tension roller 20. The platen 21 is disposed to oppose the head 11 to support the upper loop of the conveyance belt 19 from inside. The belt roller 18 is a drive roller and drives the conveyance belt 19. The belt roller 17 is a driven roller which is driven by the movement of the conveyance belt 19.

The inkjet head 11 (hereinafter, head 11) is a line-type head, and the lower surface thereof functions as an ejection surface 12 on which a plurality of nozzles are formed to eject ink. The head 11 is connected to a cartridge storing ink, via a tube (not illustrated) and a pump 80 (see FIG. 2). The pump 80 is driven when the ink is forcibly supplied to the head 11 (e.g., in purging or initial supply of liquid). The pump is on standby in other states, and the pump 80 does not obstruct the ink supply to the head 11. When the sheet P having been conveyed by the conveyance belt unit 16 is passing immediately below the head 11, the actuator of the head 11 is driven so that the black ink droplets are ejected from the nozzles to the sheet P and a desired monochrome image is recorded on the sheet P. The sheet P on which the image has been recorded is further conveyed rightward in FIG. 1 by the conveyance belt unit 16, and reaches the downstream main body guide 75.

The upstream main body guide 70 defines a conveying path from the medium storage 30*a*, which is the first one of the stages connected to the recording unit 10, to the recording unit 10. The downstream main body guide 75 defines a conveying path from the recording unit 10 to the medium supporter 40A which is on the first one of the stages connected to the recording unit 10.

Each medium storage 30 includes a sheet feeding tray 31 configured to store sheets P to be fed to the recording unit 10, an in-storage guide 32, and a power receiver 33. The medium storages 30*a* and 30*b* which are not the medium storage 30*c* which is connected to the recording unit 10 as the last stage include relay guides 35*a* and 35*b* in addition to the components above, respectively.

In each of the sheet feeding trays 31 of the respective medium storages 30, sheets P which have the size in common with all medium storages 30 are stored. The in-storage guide 32*a* defines a conveying path from the sheet feeding tray 31*a* to the upstream main body guide 70, whereas the in-storage guides 32*b* and 32*c* define conveying paths from the sheet feeding tray 31*b* or 31*c* to the relay guide 35 of the medium storage 30 on the directly preceding stage. Each of the relay guides 35*a* and 35*b* of the medium storages 30*a* and 30*b* defines a conveying path from the in-storage guide 32*a* or 32*b* to the in-storage guide 32 of the medium storage 30 on the directly succeeding stage. The power receiver 33 receives power from the power source 85.

Above each sheet feeding tray 31, a displacement sensor 97 is fixed. The displacement sensor 97 detects the number of sheets P stacked on the sheet feeding tray 31 by detecting the height of the sheets P on the sheet feeding tray 31, and outputs the detection signal to the control unit 100. This allows the control unit 100 to detect the number of sheets P in the sheet feeding tray 31 based on the detection signal.

Figure 2:
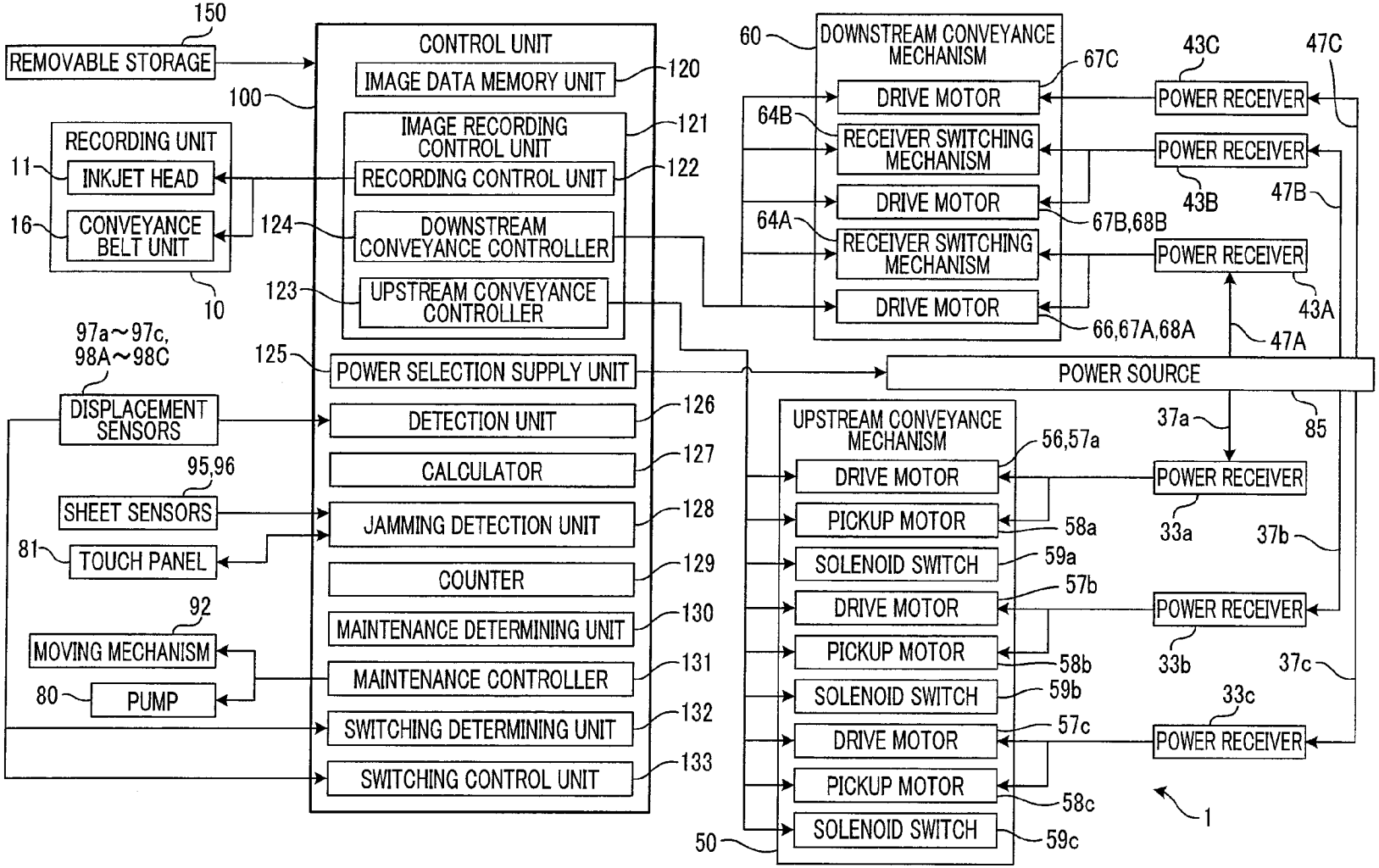
FIG. 2 shows an electric configuration of the inkjet printer shown in FIG. 1.

The upstream conveyance mechanism 50 includes body-side nipping rollers 51 and further includes three in-storage nipping rollers 52*a* to 52*c* and three pickup rollers 53*a* to 53*c* corresponding to the medium storages 30*a* to 30*c*, respectively. Furthermore, as shown in FIG. 2, the upstream conveyance mechanism 50 includes a drive motor 56 configured to rotate the body-side nipping rollers 51, drive motors 57*a* to 57*c* configured to rotate the respective in-storage nipping rollers 52*a* to 52*c*, pickup motors 58*a* to 58*c* provided to correspond to the respective pickup rollers 53*a* to 53*c*, and solenoid switches 59*a* to 59*c*.

Under the control of the control unit 100, the solenoid switches 59*a* to 59*c* switch on or off the transfer of the driving forces from the pickup motors 58*a* to 58*c* to the pickup rollers 53*a* to 53*c*. The pickup rollers 53*a* to 53*c* rotate only when the solenoid switches 59*a* to 59*c* transfer the driving forces thereto from the pickup motors 58*a* to 58*c*. As the pickup rollers 53*a* to 53*c* rotate, the topmost sheet P in the sheet feeding tray 31 of the corresponding medium storage 30 is sent out to the in-storage guide 32. As the in-storage nipping rollers 52*a* to 52*c* are rotated by the drive motors 57*a* to 57*c*, the sheet P guided to the in-storage guide 32 of the corresponding medium storage 30 is conveyed to the downstream while being nipped by the nipping rollers. The body-side nipping rollers 51 are rotated by the drive motor 56 so as to convey the sheet P guided by the upstream main body guide 70 to the recording unit 10 while nipping the same. The power for driving the drive motors 57*a* to 57*c* and the pickup motors 58*a* to 58*c* is supplied from the power receivers 33 of the corresponding medium storages 30. Therefore, when the corresponding power receiver 33 does not receive power from the power source 85, each of the drive motors 57*a* to 57*c* and the pickup motors 58*a* to 58*c* is not driven. The power for driving the drive motor 56 is supplied from the power receiver 33*a* of the medium storage 30*a*.

Each medium supporter 40 includes a sheet discharge tray 41 on which the sheets P on each of which an image has been recorded by the recording unit 10 are stacked, an in-supporter guide 42, and a power receiver 43. The medium supporters 40A and 40B which are different from the medium supporter 40C connected to the recording unit 10 as the last stage further include relay guides 45A and 45B branching off from non-end parts of the in-supporter guides 42A and 42B, in addition to the components above.

In each of the sheet discharge trays 41 of the medium supporters 40, sheets P which have the size in common with all medium supporters 40 are stored. The in-supporter guide 42A defines a conveying path from the downstream main body guide 75 to the sheet discharge tray 41A, whereas the in-supporter guides 42B and 42C define conveying paths from the relay guide 45A or 45B of the medium supporter 40 on the directly preceding stage to the sheet discharge trays 41B and 41C, respectively. The relay guides 45A and 45B define conveying paths from the branching points on the in-supporter guides 42A and 42B to the in-supporter guide 42 of the medium supporter 40 on the directly succeeding stage. The power receiver 43 receives power from the power source 85.

Above each sheet discharge tray 41, a displacement sensor 98 is fixed. The displacement sensor 98 detects the number of sheets P stacked on the sheet discharge tray 41 by detecting the height of the sheets P on the sheet discharge tray 41, and outputs the detection signal to the control unit 100. This allows the control unit 100 to detect how many sheets P can be further placed on the sheet discharge tray 41, based on the detection signal.

The downstream conveyance mechanism 60 includes two body-side nipping rollers 61 and three sheet discharge rollers 62A to 62C corresponding to the respective medium supporters 40A to 40C, and further includes two in-supporter nipping rollers 63A and 63B and two receiver switching mechanisms 64A and 64B corresponding to the respective medium supporters 40A and 40B. Furthermore, as shown in FIG. 2, the downstream conveyance mechanism 60 further includes a drive motor 66 configured to rotate the body-side nipping rollers 61, drive motors 67A to 67C configured to rotate the sheet discharge rollers 62A to 62C, and drive motors 68A and 68B configured to rotate the in-supporter nipping rollers 63A and 63B.

The body-side nipping rollers 61 are rotated by the drive motor 66 so as to convey the sheet P guided by the downstream main body guide 75 to the downstream while pinching the sheet P. The sheet discharge rollers 62A to 62C are rotated by the drive motors 67A to 67C so as to convey the sheet P guided by the in-supporter guide 42 of the corresponding medium supporter 40 to the sheet discharge tray 41 while pinching the sheet P. The in-supporter nipping rollers 63A and 63B are rotated by the drive motors 68A and 68B so as to convey the sheet P guided by the relay guides 45A and 45B to the in-supporter guide 42 of the medium supporter 40 on the directly succeeding stage, while pinching the sheet P.

The receiver switching mechanisms 64A and 64B are provided at the positions on the in-supporter guides 42A and 42B of the medium supporters 40A and 40B from which the relay guides 45A and 45B branch, and include movable claws 69A and 69B which are rotatably provided at the branching positions. The receiver switching mechanisms 64A and 64B rotate the movable claws 69A and 69B so that the movable claws 69A and 69B selectively take a relay position where the sheet P conveyed to the branching position is guided to the relay guide 45 or a sheet discharge position where the sheet P conveyed to the branching position is guided to the downstream of the in-supporter guide 42 over the branching position. The power for driving the drive motors 67A to 67C, 68A, and 68B and the receiver switching mechanisms 64A and 64B is supplied from the power receivers 43 of the corresponding medium supporters 40. When the power receivers 43 of the corresponding medium supporters 40 do not receive the power from the power source 85, each of the drive motors 67A to 67C, 68A, and 68B and the receiver switching mechanisms 64A and 64B is not driven. The power for driving the drive motor 66 is supplied from the power receiver 43A of the medium supporter 40A.

As shown in FIG. 1, the cleaning unit 90 includes a blade 91 and a moving mechanism 92 (see FIG. 2), and cleans the conveyance surface of the conveyance belt 19. The cleaning unit 90 is positioned to the lower right of the conveyance belt 19 so as to oppose the belt roller 18. The blade 91 is an elastic plate (made of, for example, rubber) and is able to contact the entire width of the conveyance belt 19 in a direction vertical to the plane of the figure. The moving mechanism 92 causes the blade 91 to contact or to be separated from the conveyance surface of the conveyance belt 19. In later-described maintenance operation, dirt on the conveyance surface is scraped off by the blade 91.

The sheet sensor 95 is provided upstream of the head 11 whereas the sheet sensor 96 is provided downstream of the head 11. The sheet sensors 95 and 96 are optical reflective sensors detecting a sheet P as the light is reflected on the surface of the sheet P. These sheet sensors 95 and 96 detect the leading edge of a sheet P conveyed by the conveyance belt unit 16 and outputs a detection signal to the control unit 100. The sheet sensors 95 and 96 may be not optical reflective sensors but optical transmissive sensors.

Now, referring to FIG. 2, an electric configuration of the printer 1 will be described. As shown in FIG. 2, the control unit 100 is connected to and able to communicate with the recording unit 10, the upstream conveyance mechanism 50, the downstream conveyance mechanism 60, the pump 80, the touch panel 81, the power source 85, the sheet sensors 95 and 96, the displacement sensors 97*a* to 97*c* and 98A to 98C, and the moving mechanism 92. Furthermore, the power source 85 is connected with the power receivers 33*a* to 33*c* and 43A to 43C by individual power lines 37*a* to 37*c* and 47A to 47*c*. This allows the power source 85 to selectively supply power to each of the medium storages 30 and to each of the medium supporters 40.

The control unit 100 includes a CPU (Central Processing Unit), a ROM (Read Only Memory) rewritably containing programs executed by the CPU and data used in the programs, and a RAM (Random Access Memory) temporarily storing data when a program is executed. The functional blocks constituting the control unit 100 are each constructed as a combination of the hardware above and the software in the ROM. As shown in FIG. 2, the control unit 100 includes an image data memory unit 120, an image recording control unit 121, a power selection supply unit 125, a detection unit 126, a calculator 127, a jam detection unit 128, a counter 129, a maintenance determining unit 130, a maintenance controller 131, a switching determining unit 132, and a switching control unit 133.

It is noted that the programs stored in the ROM of the control unit 100 are installed from a removable storage 150 storing the programs. The removable storage 150 is a non-temporary computer-readable medium. Examples of the removable storage 70 include a CD-ROM (Compact Disc Read Only Memory), a flexible disc (FD), and a Magneto Optical (MO). In a variation, the non-temporary computer-readable medium storing the programs may be a fixed recording apparatus such as a hard disc.

The image data memory unit 120 stores image data supplied from an external apparatus (such as a PC connected to the printer 1). The image data is data concerning an image recorded on at least one sheet P.

The image recording control unit 121 conducts image recording based on a printing instruction input from an external apparatus, and includes a recording control unit 122, an upstream conveyance controller 123, and a downstream conveyance controller 124. In the image recording operation, the recording control unit 122 controls the conveyance belt unit 16 so that the sheet P is conveyed in the conveyance direction at a predetermined conveyance speed, and controls the ink ejection from the head 11 such that black ink droplets are ejected onto the sheet P in accordance with the image data stored in the image data memory unit 120.

In the image recording operation, the upstream conveyance controller 123 controls the upstream conveyance mechanism 50 such that the sheet P is conveyed from a sender medium storage 30 which is one of the medium storages 30. More specifically, for example, when the sheet P is conveyed from the medium storage 30*b* which is on the second stage from the recording unit 10, the upstream conveyance controller 123 drives the pickup motor 58*b* and turns on the solenoid switch 59*b* at a predetermined timing. Because the pickup roller 53*b* is rotated as a result of the above, the sheet P is sent out from the sheet feeding tray 31*b* of the medium storage 30*b* to the in-storage guide 32*b*. Furthermore, the upstream conveyance controller 123 controls the drive motors 56, 57*a*, and 57*b* so that the sheet P is conveyed at a predetermined conveyance speed. With this, the body-side nipping rollers 51 and the in-storage nipping rollers 52*a* and 52*b* are rotated at predetermined rotation speeds, and the sheet P sent out from the sheet feeding tray 31*b* is guided to the in-storage guide 32*b*, the in-storage guide 32*b*, and the upstream main body guide 70 in this order and reaches the recording unit 10.

In the image recording operation, the downstream conveyance controller 124 controls the downstream conveyance mechanism 60 so that the sheet P on which an image has been recorded by the recording unit 10 is conveyed to a receiver medium supporter 40 which is one of the medium supporters 40. More specifically, for example, when the sheet P is conveyed to the medium supporter 40B which is connected to the recording unit 10 as the second stage, the downstream conveyance controller 124 controls the receiver switching mechanism 64A to place the movable claw 69A at the relay position (see FIG. 1) and controls the receiver switching mechanism 64B to place the movable claw 69B at the sheet discharge position (see FIG. 1). Furthermore, the downstream conveyance controller 124 controls the drive motors 66, 68A, and 67B so that the sheet P is conveyed at a predetermined conveyance speed. As a result, the body-side nipping roller 61 and the in-supporter nipping rollers 63A and 62B are rotated at predetermined rotation speeds, and the sheet P on which an image has been recorded by the recording unit 10 is guided to the downstream main body guide 75, the in-supporter guide 42A, the relay guide 45A, and the in-supporter guide 42B in this order and reaches the sheet discharge tray 41B.

The power selection supply unit 125 controls the power source 85 so that the power is selectively supplied to each of the medium storages 30, and controls the power source 85 so that the power is selectively supplied to each of the medium supporters 40. More specifically, the power selection supply unit 125 controls the power source 85 so that the power is supplied only to the sender medium storage 30 and a medium storage 30 on a stage preceding to the sender medium storage 30, among the medium storages 30. Furthermore, the power selection supply unit 125 controls the power source 85 so that the power is supplied only to the receiver medium supporter 40 and a medium supporter 40 on a stage preceding to the receiver medium supporter 40, among the medium supporters 40. With this, no power is supplied to a medium storage 30 on a stage subsequent to the sender medium storage 30 and a medium supporter 40 on a stage subsequent to the receiver medium supporter 40, with the result that the power saving is achieved.

The detection unit 126 detects the number of sheets P stored in each of the medium storages 30 based on detection signals sent from the displacement sensors 97*a* and 97*b*. Furthermore, the detection unit 126 detects how many sheets P can be further placed on each medium supporter 40, based on detection signals sent from the displacement sensors 98A and 98B. In the present embodiment, after receiving the printing instruction from the external apparatus and before the end of the image recording operation corresponding to the printing instruction, the detection unit 126 intermittently detects the number of sheets P stored in each of the medium storages 30 and how many sheets P can be placed on each of the medium supporters 40.

The calculator 127 calculates the number of sheets P required to record all remaining images on sheets P by the recording unit 10 in accordance with the image data stored in the image data memory unit 120. More specifically, before the image recording control unit 121 starts the image recording operation, the calculator 127 calculates the number of sheets P required to record all images on sheets P in accordance with the image data stored in the image data memory unit 120, and sets the calculated number as a required recording number. Each time an image is recorded on a single sheet P in accordance with the image data by the recording unit 10, the calculator 127 subtracts one from the required recording number. This makes it possible to precisely calculate the required recording number of the sheets P required to record all images on sheets P in accordance with the image data.

The jamming detection unit 128 detects that jamming occurs in the conveyance belt unit 16 (i.e., between the ejection surface 12 and the conveyance belt 19) when, while the image recording control unit 121 is conducting image recording (i.e., an image is being recorded on the sheet P based on the image data), the interval between the detections of the leading end of the sheet P by the two sheet sensors 95 and 96 exceeds a predetermined time. This predetermined time is calculated by dividing the conveyance distance between the two sheet sensors 95 and 96 by the conveyance speed of the sheets P. Furthermore, upon detection of the jamming, the jam detection unit 128 causes the touch panel 81 to display a screen which notifies the user of the occurrence of the jamming. When the above-described jamming occurs, the user recognizes the occurrence of the jamming and removes the jammed sheet P as described above.

The counter 129 starts to count the number of sheets P on which image recording has been done by the recording unit 10 in accordance with the image data, at a later one of the following timings: when the recording of images onto sheets P by the recording unit 10 in accordance with image data starts (i.e., when the image recording operation starts); and when the previous maintenance operation is conducted by the maintenance controller 131.

The maintenance determining unit 130 determines whether a maintenance operation of conducting the maintenance of the recording unit 10 is necessary. Furthermore, when the above-described jamming occurs and the sheet P contacts the ejection surface 12, paper particles of the sheet P, ink ejected from the head 11 or the like may adhere to the ejection surface 12 of the head 11. Furthermore, the meniscus of each nozzle of the head 11 may be broken. If the image recording is continued in this state, adverse effects such as the deterioration in the image quality on the sheets P may be caused. For this reason, the maintenance determining unit 130 determines that the maintenance operation is necessary, when the jam detection unit 128 detects the occurrence of jamming.

In addition to the above, during the image recording operation by the image recording control unit 121, the ink in the nozzles which has not ejected ink for a predetermined time is thickened and the ink ejection property is deteriorated. In this regard, in the present embodiment, the maintenance determining unit 130 determines that the maintenance operation is necessary when the number of sheets P counted by the counter 129 reaches a predetermined number (hereinafter, this may be referred to as a maintenance requiring number).

The maintenance controller 131 controls the pump 80 and the cleaning unit 90 to conduct the maintenance operation of the recording unit 10 when the maintenance determining unit 130 determines that the maintenance operation is necessary. The maintenance operation includes a purging operation for recovering the ejection property of the nozzles of the head 11 and a cleaning operation for cleaning the conveyance belt unit 16. In the purging operation, the pump 80 is driven to forcibly eject ink from the nozzles of the head 11. The cleaning operation which is conducted after the purging operation is an operation to control the moving mechanism 92 to cause the blade 91 to contact the conveyance surface of the conveyance belt 19 and to control the conveyance belt unit 16 to move the conveyance belt 19 so as to remove the ink or the like ejected onto the conveyance surface of the conveyance belt 19. In the present embodiment, the pump 80 and the cleaning unit 90 constitute the maintenance mechanism of the present invention. In a variation, a flushing operation may be conducted in place of the purging operation. The flushing operation is an action to forcibly eject ink through the nozzles by driving the actuator of the head 11.

When the maintenance determining unit 130 has determined that the maintenance operation is necessary on account of the detection of the occurrence of jamming by the jam detection unit 128, the maintenance controller 131 starts the maintenance operation after the user inputs a printing restart instruction through the touch panel 81.

In addition to the above, the maintenance controller 131 stops the image recording operation during the maintenance period in which the maintenance operation is executed. More specifically, the maintenance controller 131 controls the recording unit 10, the upstream conveyance mechanism 50, and the downstream conveyance mechanism 60 via the image recording control unit 121 so that the conveyance of the sheets P from the sender medium storage 30 to the recording unit 10, the conveyance of the sheets P from the recording unit 10 to the receiver medium supporter 40, and the image recording on the sheets P are not executed.

When the number of sheets P stored in a medium storage 30 which is currently selected as the sender medium storage 30 becomes zero, it is necessary to conduct a switching operation to switch the sender medium storage 30 to another one. In this regard, as described above, the power is supplied from the power selection supply unit 125 to only the sender medium storage 30 and a medium storage 30 which is on a stage preceding to the sender medium storage 30, among the medium storages 30. For this reason, the drive motor 57 and the pickup motor 58 of a medium storage 30 which is on a stage subsequent to the sender medium storage 30 are not driven. Therefore, when, for example, in the switching operation to switch the sender medium storage 30, the sender medium storage 30 is switched to the medium storage 30 on a stage subsequent to the medium storage 30 having been selected as the sender, the power must be supplied by the power selection supply unit 125 from the power source 85 to at least the newly-selected sender medium storage 30, and the image recording must be stopped until the drive motor 57 and the pickup motor 58 receiving power from the power receiver 33 of the newly-selected sender medium storage 30 are normally driven. When the image recording operation is frequently stopped by the switching of the sender medium storage 30 and the maintenance operation above, the user waiting time becomes long.

In this regard, the present embodiment is arranged such that, to shorten the user waiting time, the sender medium storage 30 is switched during the maintenance time, when a predetermined condition is satisfied. The switching determining unit 132 determines whether the predetermined condition is satisfied, i.e., whether the switching operation of switching the sender medium storage 30 is conducted during the maintenance period. More specifically, to begin with, the switching determining unit 132 determines whether the number of sheets P stored in the sender medium storage 30 detected by the detection unit 126 is smaller than the required recording number calculated by the calculator 127, at the start of the maintenance period. When it is determined that the number of sheets P stored in the sender medium storage 30 is not smaller than the required recording number, it is unnecessary to switch the sender medium storage 30 during the image recording operation (i.e., until all images in accordance with the image data stored in the image data memory unit 120 are recorded on the sheets P), and hence it is determined that the switching operation to switch the sender medium storage 30 is not executed during the maintenance period.

In addition to the above, when it is determined that the number of sheets P stored in the sender medium storage 30 is smaller than the required recording number, the switching determining unit 132 determines whether there is at least one predetermined remaining number medium storage which is a medium storage 30 in which the number of sheets P stored is larger than the number of sheets P stored in the sender medium storage 30. When there is no predetermined remaining number medium storage, the switching determining unit 132 determines not to switch the sender medium storage 30 during the maintenance period, because, even if the sender medium storage 30 is switched to another medium storage 30 during the maintenance period, the switching of the sender medium storage 30 must be done again during the image recording operation. On the other hand, when it is determined that there is at least one predetermined remaining number medium storage, the switching determining unit 132 determines that the switching of the sender medium storage 30 is executed during the maintenance period. The timing to switch the sender medium storage 30 during the maintenance period is optionally determined on condition that at least a part of the switching period in which the switching is conducted overlaps the maintenance period. For example, the switching starts during the maintenance period and ends after the maintenance period.

The switching control unit 133 conducts the switching of the sender medium storage 30. More specifically, the switching control unit 133 selects the medium storage 30 storing the largest number of sheets P as the sender medium storage 30 based on a result of detection by the detection unit 126, when the switching determining unit 132 has determined that the switching of the sender medium storage 30 is conducted during the maintenance period, when the image recording operation starts, and when the detection unit 126 has detected that the number of sheets P stored in the sender medium storage 30 is zero. As a variation, the switching control unit 133 may select, as the sender medium storage 30, a predetermined remaining number medium storage in which the number of sheets P detected by the detection unit 126 is not smaller than the number of sheets P required to record all remaining images, from the predetermined remaining number medium storages. Then the switching control unit 133 controls the power source 85 via the power selection supply unit 125 so that the power is supplied to only the sender medium storage 30 and a medium storage 30 on a stage preceding to the sender medium storage 30, among the medium storages 30. Thereafter, the switching control unit 133 controls the upstream conveyance mechanism 50 via the upstream conveyance controller 123 so that the sheets P are conveyed from the sender medium storage 30 to the recording unit 10.

In addition to the above, the switching control unit 133 executes the switching of the receiver medium supporter 40, too. More specifically, the switching control unit 133 selects the medium supporter 40 to which the largest number of sheets can be placed among the medium supporters 40 based on a result of detection by the detection unit 126, when the image recording operation starts and when the detection unit 126 has detected that the number of sheets P placeable on the receiver medium supporter 40 is zero. The switching control unit 133 then controls the power source 85 via the power selection supply unit 125 so that the power is supplied to only the receiver medium supporter 40 and a medium supper 40 on a stage preceding to the receiver medium supporter 40, among the medium supporters 40. Thereafter, the switching control unit 133 controls the downstream conveyance mechanism 60 via the downstream conveyance controller 124 so that the sheets P on which images have been recorded by the recording unit 10 are conveyed to the receiver medium supporter 40.

In addition to the above, the switching control unit 133 stops the image recording operation during the switching period in which an operation to switch the sender medium storage 30 is conducted and an operation to switch the receiver medium supporter 40 is conducted. More specifically, the switching control unit 133 controls the recording unit 10, the upstream conveyance mechanism 50, and the downstream conveyance mechanism 60 via the recording control unit 122, the upstream conveyance controller 123, and the downstream conveyance controller 124 so that the conveyance of the sheets P from the sender medium storage 30 to the recording unit 10, the conveyance of the sheets P from the recording unit 10 to the receiver medium supporter 40, and the image recording onto the sheets P are not conducted.

Figure 3:
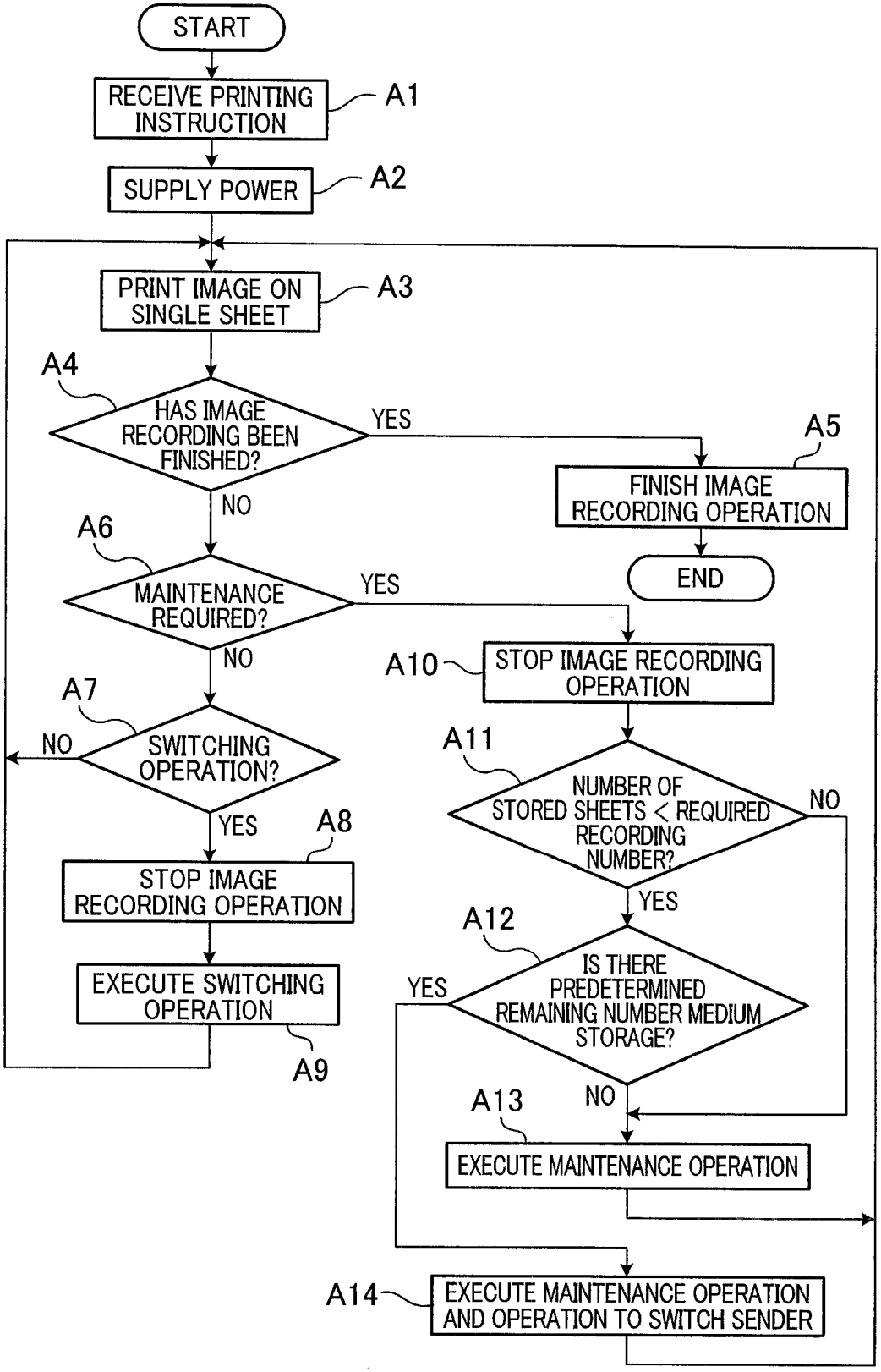
FIG. 3 shows an operation flow of the inkjet printer shown in FIG. 1.

Now, the operation of the printer 1 will be described with reference to FIG. 3. To begin with, when a printing instruction is input from an external apparatus (A1), the switching control unit 133 selects a medium storage 30 storing the largest number of sheets P among the medium storages 30 as a sender medium storage 30, based on a result of detection by the detection unit 126, and controls the power source 85 via the power selection supply unit 125 so that the power is supplied to only the sender medium storage 30 and a medium storage 30 on a stage preceding to the sender medium storage 30 (A2). At the same time, the switching control unit 133 selects a medium supporter 40 to which the largest number of sheets can be placed among the medium supporters 40 based on a result of detection by the detection unit 126, and controls the power source 85 via the power selection supply unit 125 so that the power is supplied to only the receiver medium supporter 40 and a medium supporter 40 which is on a stage preceding to the receiver medium supporter 40.

Subsequently, the image recording control unit 121 starts the image recording operation to record an image on a single sheet P based on the image data stored in the image data memory unit 120 (A3). More specifically, the upstream conveyance controller 123 controls the upstream conveyance mechanism 50 so that, in the image recording operation, one of the medium storages 30 is selected as a sender medium storage and a single sheet P is conveyed to the recording unit 10. Furthermore, the recording control unit 122 controls the conveyance belt unit 16 so that the sheet P conveyed by the upstream conveyance mechanism 50 moves at a predetermined conveyance speed along the conveyance direction and controls the ink ejection of the head 11 so that black ink droplets are ejected onto the sheet P based on the image data stored in the image data memory unit 120. Furthermore, the downstream conveyance controller 124 controls the downstream conveyance mechanism 60 so that the sheet P on which an image has been recorded by the recording unit 10 is conveyed to a receiver medium supporter 40 which is one of the medium supporters 40.

Subsequently, the image recording control unit 121 determines whether all images have been recorded on sheets P in accordance with the image data stored in the image data memory unit 120, by determining whether the required recording number calculated by the calculator 127 is zero (A4). When all images have been recorded on the sheets P in accordance with the image data (A4: YES), the image recording control unit 121 finishes the image recording operation and the power selection supply unit 125 controls the power source 85 so that the power supply to all medium storages 30 and all medium supporters 40 is stopped (A5), and the process is finished.

On the other hand, if it is determined in the step A4 that not all images have been recorded on the sheets P in accordance with the image data (A4: NO), the maintenance determining unit 130 determines whether it is necessary to conduct the maintenance operation (A6). If the maintenance determining unit 130 determines that the maintenance operation is unnecessary (A6: NO), the switching control unit 133 determines whether the detection unit 126 has detected that the number of sheets P stored in the sender medium storage 30 is zero or determines whether the detection unit 126 has detected that the number of sheets P placeable on the receiver medium supporter 40 is zero (A7). When the number of sheets P stored in the sender medium storage 30 is not zero and the number of sheets P placeable on the receiver medium supporter 40 is not zero according to the detection unit 126 (A7: NO), the process goes back to the step A3 to continue the image recording operation.

On the other hand, when the switching control unit 133 has determined that the number of sheets P stored in the sender medium storage 30 is zero according to the detection unit 126 or the number of sheets P placeable on the receiver medium supporter 40 is zero according to the detection unit 126 (A7: YES), the switching control unit 133 controls the recording unit 10, the upstream conveyance mechanism 50, and the downstream conveyance mechanism 60 via the image recording control unit 121 to stop the image recording operation (A8), and the process proceeds to the step A9.

In the step A9, the switching control unit 133 conducts the switching of the sender medium storage 30 when the detection unit 126 has detected that the number of sheets P stored in the sender medium storage 30 is zero. More specifically, based on a result of detection by the detection unit 126, the switching control unit 133 selects, as a new sender medium storage 30, a medium storage 30 storing the largest number of sheets P. Then the switching control unit 133 controls the power source 85 via the power selection supply unit 125 so that the power is supplied to only the new sender medium storage 30 and a medium storage 30 on a stage preceding to that sender medium storage 30, among the medium storages 30. Furthermore, the switching control unit 133 controls the upstream conveyance mechanism 50 via the upstream conveyance controller 123 so that the sheets P are conveyed from the new sender medium storage 30 to the recording unit 10 in the image recording operation after this control.

When it is determined based on a result of detection by the detection unit 126 that the number of sheets P is zero in all medium storages 30, the switching control unit 133 controls the touch panel 81 so that a screen notifying the user that the sheet run out is displayed. This allows the user to understand the sheets run out, and the user supplies sheets P to the medium storages 30. In this case, after the sheets P are supplied by the user, the switching control unit 133 selects a new sender medium storage 30.

When the detection unit 126 has detected that the number of sheets P placeable on the receiver medium supporter 40 is zero, the switching control unit 133 conducts the switching of the receiver medium supporter 40. More specifically, based on a result of detection by the detection unit 126, the switching control unit 133 selects, from the medium supporters 40, a medium supporter 40 to which the largest number of sheets P are placeable as a new receiver medium supporter 40. Then the switching control unit 133 controls the power source 85 via the power selection supply unit 125 so that the power is supplied to only the new receiver medium supporter 40 and a medium storage 30 on a stage preceding to that receiver medium supporter 40, among the medium supporters 40. Furthermore, the switching control unit 133 controls the downstream conveyance mechanism 60 via the downstream conveyance controller 124 so that the sheets P on which images have been recorded by the recording unit 10 are sent to the new receiver medium supporter 40 in the image recording operation after this control.

When it is determined that the number of placeable sheets P is zero in all medium supporters 40 based on a result of detection by the detection unit 126, the switching control unit 133 controls the touch panel 81 so that a screen notifying the user that the sheets P must be removed from the medium supporter 40 is displayed. In response to this, the user removes the sheets P from the medium supporters 40. Furthermore, after the sheets P are removed by the user, the switching control unit 133 selects a new receiver medium supporter 40. After the step A9, the process goes back to the step A3 to resume the image recording operation.

In the meanwhile, if the maintenance determining unit 130 has determined in the step A6 that the maintenance operation is necessary (A6: YES), the maintenance controller 131 controls the recording unit 10, the upstream conveyance mechanism 50, and the downstream conveyance mechanism 60 via the image recording control unit 121 so as to stop the image recording operation (A10). Subsequently, the switching determining unit 132 determines, at the start of the maintenance period, whether the number of sheets P stored in the sender medium storage 30 detected by the detection unit 126 is smaller than the required recording number calculated by the calculator 127 (A11). When the number of sheets P stored in the sender medium storage 30 is not smaller than the required recording number (A11: NO), the switching determining unit 132 determines that the switching of the sender medium storage 30 is unnecessary during the maintenance period, and the process goes back to the step A13.

On the other hand, when the number of sheets P stored in the sender medium storage 30 is smaller than the required recording number (A11: YES), the switching determining unit 132 determines whether there is at least one predetermined remaining number medium storage which is a medium storage 30 storing more sheets P than the sender medium storage 30, among the medium storages 30 (A12). When there is no predetermined remaining number medium storage (A12: NO), the switching determining unit 132 determines that the switching of the sender medium storage 30 is not conducted during the maintenance period, and the process proceeds to the step A13. On the other hand, when there is at least one predetermined remaining number medium storage (A12: YES), the switching determining unit 132 determines that the switching of the sender medium storage 30 is conducted during the maintenance period, and the process proceeds to the step A14.

In the step A13, the maintenance controller 131 drives the pump 80 so that ink is forcibly ejected from the nozzles of the head 11, in order to execute to the maintenance operation (purging operation). With this, the ejection property of the nozzles of the head 11 is restored. Thereafter, the maintenance controller 131 controls the moving mechanism 92 to cause the blade 91 to contact the conveyance surface of the conveyance belt 19 and controls the conveyance belt unit 16 to move the conveyance belt 19 (cleaning operation). With this, the ink or the like ejected onto the conveyance surface of the conveyance belt 19 is removed. After the step A13, the process goes back to the step A3 to resume the image recording operation.

In the meanwhile, in the step A14 a maintenance operation similar to the operation in the step A13 above is executed by the maintenance controller 131. Furthermore, in the maintenance period in which the maintenance operation above is executed, the switching control unit 133 conducts the switching of the sender medium storage 30. To be more specific, based on a result of detection by the detection unit 126, the switching control unit 133 selects, as a new sender medium storage 30, a medium storage 30 storing the largest number of sheets P among the medium storages 30. Then the switching control unit 133 controls the power source 85 via the power selection supply unit 125 so that the power is supplied to only the new sender medium storage 30 and a medium storage 30 on a stage preceding to the sender medium storage 30, among the medium storages 30. Furthermore, the switching control unit 133 controls the upstream conveyance mechanism 50 via the upstream conveyance controller 123 so that the sheets P are conveyed from the new sender medium storage 30 to the recording unit 10 in the image recording operation after this control. After the step A14, the process goes back to the step A3 to resume the image recording operation. The printer 1 operates in this way.

As described above, because in the present embodiment the switching of the sender medium storage 30 is conducted during the maintenance period, the frequency and duration of stopping the image recording operation are reduced. This reduces the user waiting time. Furthermore, when the switching of the sender medium storage 30 is conducted during the maintenance period, a medium storage 30 storing the largest number of sheets P is selected as a new sender medium storage 30 among the predetermined remaining number medium storages, and hence the frequency of stopping the image recording operation on account of the switching of the sender medium storage 30 during the image recording operation is reduced. As a variation, when the switching of the sender medium storage 30 is conducted during the maintenance period, if according to the detection unit 126 there are more than one medium storages 30 each storing sheets P the number of which is not smaller than the required recording number calculated by the calculator 127 as the predetermined remaining number medium storages, one of these medium storages 30 may be selected as a new sender medium storage 30. Also in this case, the frequency of stopping the image recording operation due to the switching of the sender medium storage 30 during the image recording operation is reduced. Furthermore, the power saving is achieved because no power is supplied to a medium storage 30 on a stage subsequent to the sender medium storage 30 and a medium supporter 40 on a stage subsequent to the receiver medium supporter 40.

Figure 4:
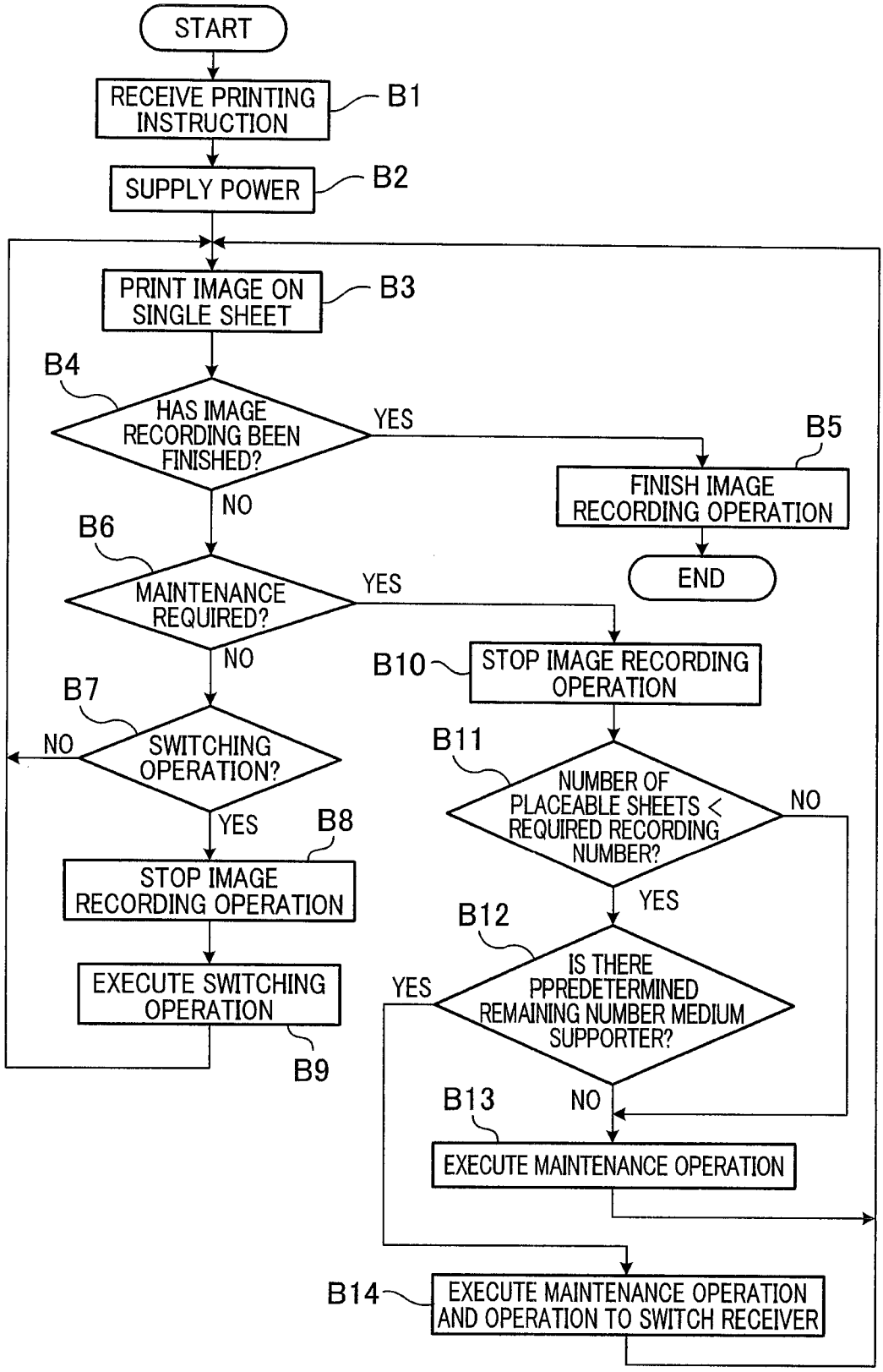
FIG. 4 shows an operation flow of an inkjet printer of Second Embodiment.

Now, the following will describe Second Embodiment of the present invention with reference to FIG. 4. Second Embodiment is different from First Embodiment in that, while in First Embodiment the switching of the sender medium storage 30 is conducted during the maintenance period when the predetermined condition is satisfied, in the present embodiment the switching of the receiver medium supporter 40 is conducted during the maintenance period. In the present embodiment, members identical with those in the embodiment above will be denoted by the same reference numerals and the descriptions thereof will be suitably omitted. It is noted that the timing to start the switching of the receiver medium supporter 40 during the maintenance period is optionally determined on condition that at least a part of the switching period in which the switching is conducted overlaps the maintenance period.

In the present embodiment, the switching determining unit 132 determines whether to conduct the switching of the receiver medium supporter 40 during the maintenance period. To be more specific, to begin with, the switching determining unit 132 determines at the start of the maintenance period whether the number of sheets P placeable on the receiver medium supporter 40 detected by the detection unit 126 is smaller than a required recording number calculated by the calculator 127. When the number of sheets P placeable on the receiver medium supporter 40 is not smaller than the required recording number, the switching determining unit 132 determines not to switch the receiver medium supporter 40 during the maintenance period because it is unnecessary to switch the receiver medium supporter 40 during the image recording operation.

When the number of sheets P placeable on the receiver medium supporter 40 is smaller than the required recording number, the switching determining unit 132 determines whether there is at least one predetermined remaining number medium supporter which is a medium supporter 40 on which more sheets P are placeable than on the receiver medium supporter 40, among the medium supporters 40. When there is no predetermined remaining number medium supporter, the switching determining unit 132 determines that the switching of the receiver medium supporter 40 is not conducted during the maintenance period, because, even if the receiver medium supporter 40 is switched to another medium supporter 40 during the maintenance period, the switching of the receiver medium supporter 40 must be conducted again during the image recording operation. On the other hand, when there is at least one predetermined remaining number medium supporter, the switching determining unit 132 determines that the switching of the receiver medium supporter 40 is conducted during the maintenance period.

Also when the switching determining unit 132 determines that the switching of the receiver medium supporter 40 is conducted during the maintenance period, the switching control unit 133 conducts the switching of the receiver medium supporter 40. More specifically, based on a result of detection by the detection unit 126, the switching control unit 133 selects, as a receiver medium supporter 40, a medium supporter 40 on which the largest number of sheets P are placeable among the medium supporters 40. The switching control unit 133 then controls the power source 85 via the power selection supply unit 125 so that the power is supplied only to the receiver medium supporter 40 and a medium supporter 40 on a stage preceding to the receiver medium supporter 40 among the medium supporters 40. Thereafter, the switching control unit 133 controls the downstream conveyance mechanism 60 via the downstream conveyance controller 124 so that the sheets P on which images have been recorded by the recording unit 10 are conveyed to the receiver medium supporter 40.

Now, the operation of the printer 1 of the present embodiment will be described with reference to FIG. 4. The steps B1 to B10 are not described here because they are substantially identical with the steps A1 to A10 described above.

In the step B11, the switching determining unit 132 determines whether at the start of the maintenance period the number of sheets P placeable on the receiver medium supporter 40 detected by the detection unit 126 is smaller than the required recording number calculated by the calculator 127. When the number of sheets P placeable on the receiver medium supporter 40 is not smaller than the required recording number (B11: NO) the switching determining unit 132 determines that the switching of the receiver medium supporter 40 is not conducted during the maintenance period, and the process proceeds to the step B13.

On the other hand, when the number of sheets P placeable on the receiver medium supporter 40 is smaller than the required recording number (B11: YES), the switching determining unit 132 determines whether there is at least one predetermined remaining number medium supporter which is a medium supporter 40 on which more sheets P are placeable than on the receiver medium supporter 40 among the medium supporters 40 (B12). When there is no predetermined remaining number medium supporter (B12: NO), the switching determining unit 132 determines that the switching of the receiver medium supporter 40 is not conducted during the maintenance period, and the process proceeds to the step B13. On the other hand, when there is at least one predetermined remaining number medium supporter (B12: YES), the switching determining unit 132 determines that the switching of the receiver medium supporter 40 is conducted during the maintenance period, and the process proceeds to the step B14.

In the step B13, the maintenance controller 131 executes a maintenance operation similar to the operation in the step A13 above. After the step B13, the process goes back to the step B3 to resume the image recording operation. In the meanwhile, in the step B14 the maintenance controller 131 executes a maintenance operation similar to an operation in the step A13 above. In the maintenance period in which the maintenance operation above is executed, the switching control unit 133 conducts the switching of the receiver medium supporter 40. After the step B14, the process goes back to the step B3 to resume the image recording operation. The printer 1 operates in this way.

As described above, according to the present embodiment, because the switching of the receiver medium supporter 40 is conducted during the maintenance period, the frequency and duration of stopping the image recording operation are reduced. The user waiting time is therefore reduced.

Now, Third Embodiment of the present invention will be described with reference to FIG. 5 and FIG. 6. Third Embodiment is different from First Embodiment in that, while in First Embodiment above the switching of the sender medium storage 30 is conducted during the maintenance period to reduce the user waiting time, in the present embodiment a maintenance operation is conducted during a switching period in which the switching of the sender medium storage 30 is conducted. In the present embodiment, members identical with those in the embodiment above will be denoted by the same reference numerals and the descriptions thereof will be suitably omitted. It is noted that the timing to start the maintenance operation during the switching period in which the switching of the sender medium storage 30 is conducted is optionally determined on condition that at least a part of the maintenance period in which the maintenance operation is conducted overlaps the switching period.

Figure 5:
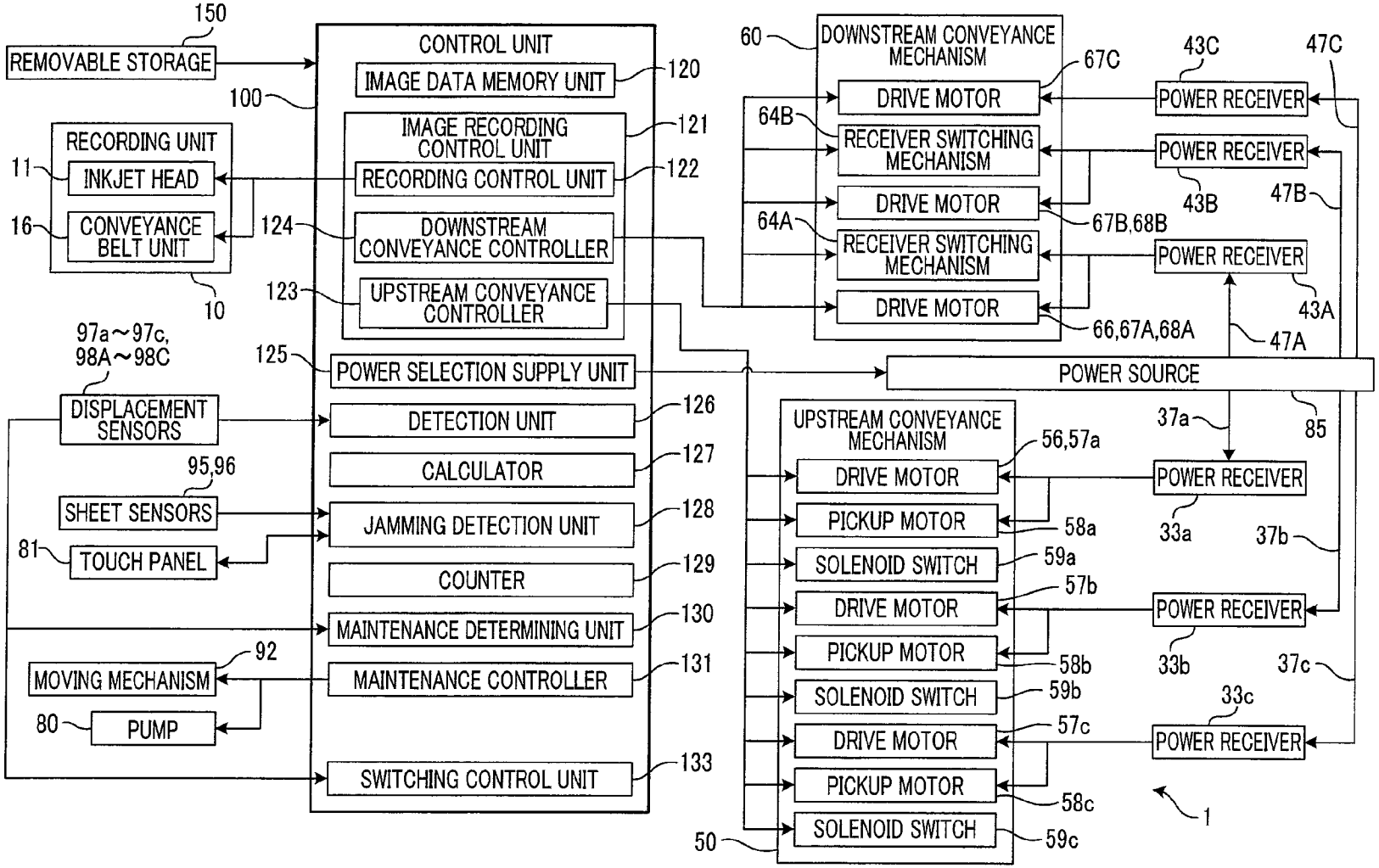
FIG. 5 shows an electric configuration of an inkjet printer of Third Embodiment.
Figure 6:
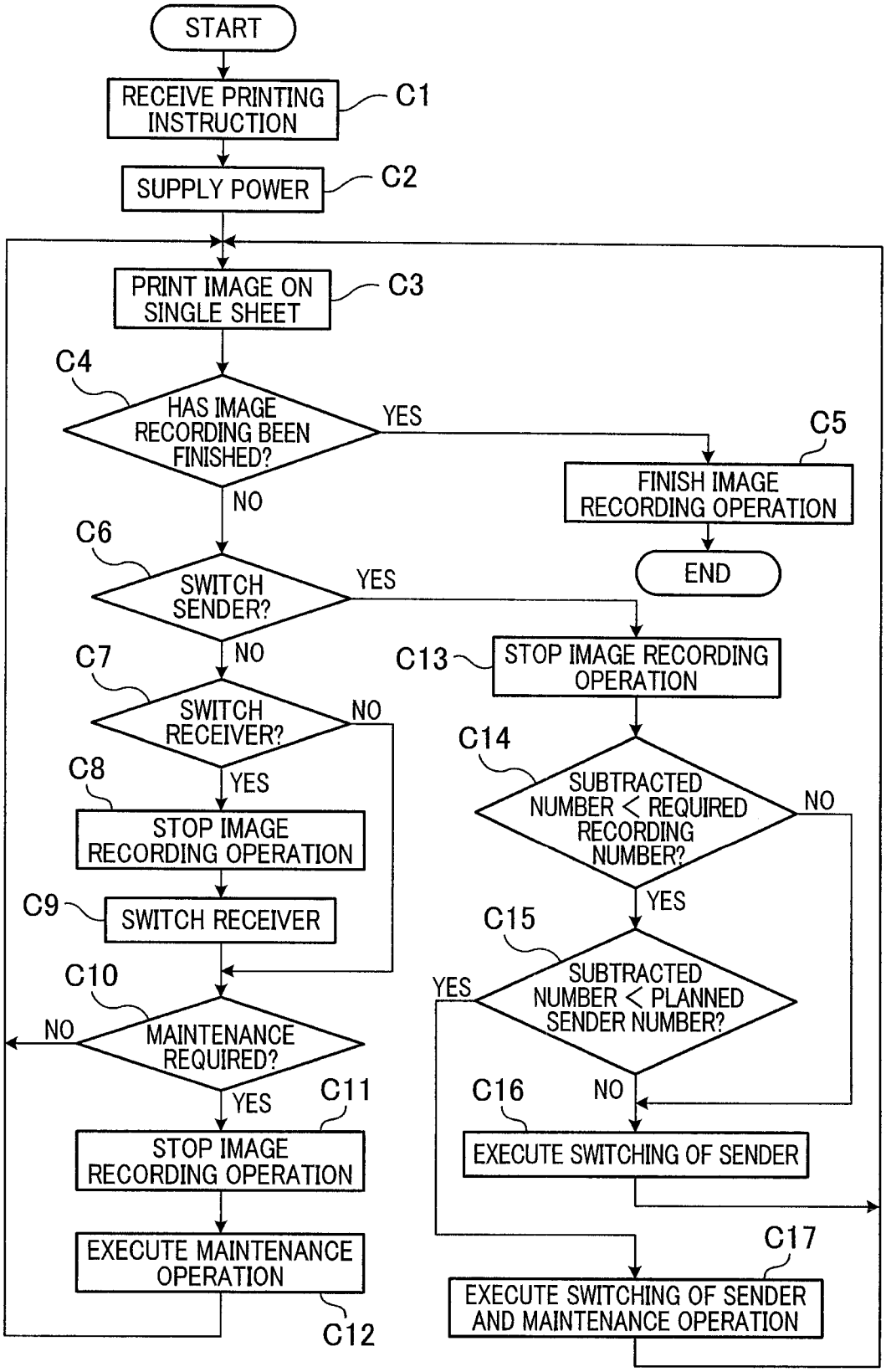
FIG. 6 shows an operation flow of the inkjet printer shown in FIG. 5.

As shown in FIG. 5, a control unit 100 of the present embodiment does not include the switching determining unit 132. Furthermore, the maintenance determining unit 130 determines whether to conduct the maintenance operation during the switching period in which the switching of the sender medium storage 30 is conducted. More specifically, to begin with, the maintenance determining unit 130 determines at the start of the switching period whether a number (hereinafter, subtracted number) calculated by subtracting the number of sheets P counted by the counter 129 from the maintenance requiring number at which the maintenance operation is necessary to restore the ink ejection property is smaller than the required recording number calculated by the calculator 127. When the subtracted number is not smaller than the required recording number, it is determined that the maintenance operation is not conducted during the switching period because it is unnecessary in the image recording operation to conduct any maintenance operation other than the maintenance operation for resolving the jamming.

In addition to the above, when the subtracted number is smaller than the required recording number, the maintenance determining unit 130 determines whether the subtracted number is smaller than the number of sheets P (hereinafter, planned sender number of sheets) stored in a medium storage 30 which has been detected by the detection unit 126 to function as a sender medium storage 30 after the switching period in which the sender medium storage 30 is switched. When the subtracted number is not smaller than the planned sender number of sheets, the maintenance determining unit 130 determines not to conduct the maintenance operation in the current switching period, because the maintenance operation will be conducted in the next or subsequent switching period in which the switching of the sender medium storage 30 is conducted. On the other hand, when the subtracted number is smaller than the planned sender number of sheets, the maintenance determining unit 130 determines that the maintenance operation is conducted in the current switching period.

Now, the operation of the printer 1 of the present embodiment will be described with reference to FIG. 6. The steps C1 to C5 are not described here because they are substantially identical with the steps A1 to A5 described above.

In the step C6, the switching control unit 133 determines whether the switching of the sender medium storage 30 is necessary based on whether the detection unit 126 has detected that the number of sheets P stored in the sender medium storage 30 is zero. When the switching of the sender medium storage 30 is unnecessary (C6: NO), the switching control unit 133 determines whether the switching of the receiver medium supporter 40 is necessary based on whether the detection unit 126 has detected that the number of sheets P placeable on the receiver medium supporter 40 is zero (C7).

When the switching of the receiver medium supporter 40 is unnecessary (C7: NO), the process goes back to the step C10. On the other hand, when the switching of the receiver medium supporter 40 is necessary (C7: YES), the switching control unit 133 controls the recording unit 10, the upstream conveyance mechanism 50, and the downstream conveyance mechanism 60 via the image recording control unit 121 so as to stop the image recording operation (C8). Then the switching control unit 133 conducts the switching of the receiver medium supporter 40 (C9). After the step C9, the process proceeds to the step C10.

In the step C10, the maintenance determining unit 130 determines whether the maintenance operation is necessary by determining whether the jam detection unit 128 has detected the occurrence of jamming and whether the number of sheets P counted by the counter 129 has reached the maintenance requiring number. When the maintenance operation is unnecessary (C10: NO), the process goes back to the step C3 to continue the image recording operation. On the other hand, when the maintenance operation is necessary (C10: YES), the maintenance controller 131 controls the recording unit 10, the upstream conveyance mechanism 50, and the downstream conveyance mechanism 60 via the image recording control unit 121 to stop the image recording operation or to continue the suspension of the image recording operation (C11). Subsequently, the maintenance controller 131 executes a maintenance operation similar to the operation in the step A13 above (C12), and the process goes back to the step C3 to resume the image recording operation.

If the switching control unit 133 has determined in the step C6 that the switching of the sender medium storage 30 is necessary (C6: YES), the switching control unit 133 controls the recording unit 10, the upstream conveyance mechanism 50, and the downstream conveyance mechanism 60 via the image recording control unit 121 to stop the image recording operation (C13). Subsequently, the maintenance determining unit 130 determines at the start of the switching period whether the subtracted number calculated by subtracting the number of sheets P counted by the counter 129 from the maintenance requiring number is smaller than the required recording number calculated by the calculator 127 (C14). When the subtracted number is not smaller than the required recording number (C14: NO), it is determined that the maintenance operation is not conducted during the switching period, and the process proceeds to the step C16.

On the other hand, when the subtracted number is smaller than the required recording number (C14: YES), the maintenance determining unit 130 determines whether the subtracted number is smaller than a planned sender number of sheets in a medium storage 30 which is detected by the detection unit 126 to function as a sender medium storage 30 after the switching period (C15). When the subtracted number is not smaller than the planned sender number of sheets (C15: NO), the maintenance determining unit 130 determines that the maintenance operation is not conducted during the switching period, and the process proceeds to the step C16. On the other hand, when the subtracted number is smaller than the planned sender number of sheets (C15: YES), the maintenance determining unit 130 determines that the maintenance operation is conducted during the switching period, and the process proceeds to the step C17.

In the step C16, the switching control unit 133 conducts the switching of the receiver medium supporter 40. After the step C16, the process goes back to the step C3 to resume the image recording operation. In the step C17, the switching control unit 133 executes an operation similar to the operation in the step C16 above. During the switching period of switching the sender medium storage 30 by the switching control unit 133, the maintenance controller 131 executes a maintenance operation similar to the operation in the step A13 above. After the step C17, the process goes back to the step C3 to resume the image recording operation. The printer 1 operates in this way.

As described above, according to the present embodiment, the frequency and duration of stopping of the image recording operation are reduced because the maintenance operation is executed during the switching period in which the switching of the sender medium storage 30 is conducted. This reduces the user waiting time.

Figure 7:
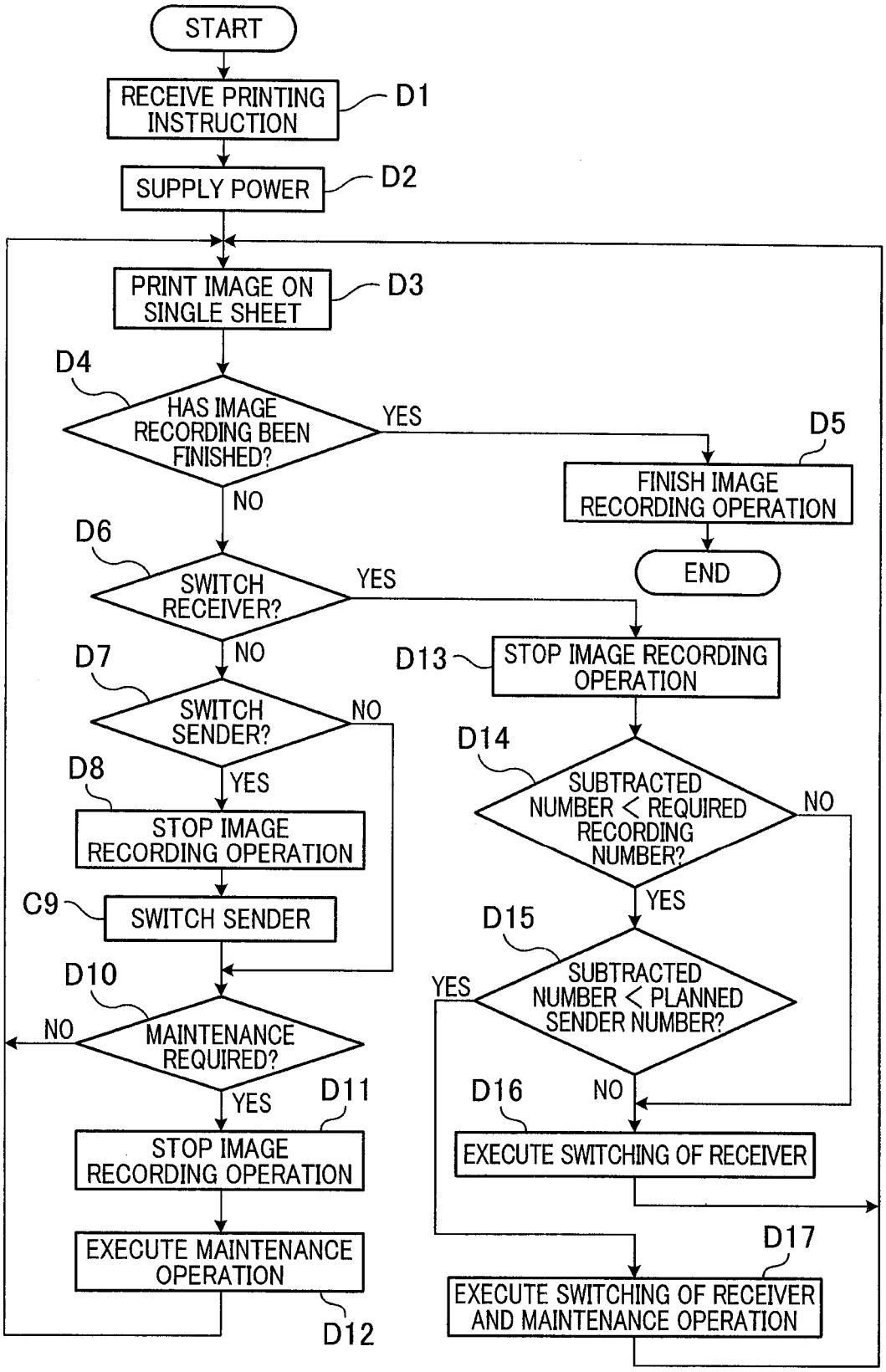
FIG. 7 shows an operation flow of an inkjet printer of Fourth Embodiment.

The following will describe Fourth Embodiment of the present invention with reference to FIG. 7. In Fourth Embodiment, the maintenance operation is executed during the switching period in which the switching of the receiver medium supporter 40 is conducted, while in Third Embodiment the maintenance operation is executed during the switching period in which the switching of the sender medium storage 30 is conducted. In the present embodiment, members identical with those in the embodiments above will be denoted by the same reference numerals and the descriptions thereof will be suitably omitted. It is noted that the timing to start the maintenance operation during the switching period in which the switching of the receiver medium supporter 40 is conducted is optionally determined on condition that at least a part of the maintenance period in which the maintenance operation is conducted overlaps the switching period.

The maintenance determining unit 130 of the control unit 100 of the present embodiment determines whether the maintenance operation is executed during the switching period in which the switching of the receiver medium supporter 40 is conducted. More specifically, to begin with, the maintenance determining unit 130 determines at the start of the switching period whether a subtracted number calculated by subtracting the number of sheets P counted by the counter 129 from the maintenance requiring number is smaller than the required recording number calculated by the calculator 127. When the subtracted number is not smaller than the required recording number, the maintenance operation is not executed during the switching period.

On the other hand, when the subtracted number is smaller than the required recording number, the maintenance determining unit 130 determines whether the subtracted number is smaller than the number of sheets P (hereinafter, planned receiver number of sheets) placeable on a medium supporter 40 which is detected by the detection unit 126 to function as a receiver medium supporter 40 after the switching period of switching the receiver medium supporter 40. When the subtracted number is not smaller than the planned receiver number of sheets, the maintenance determining unit 130 determines not to conduct the maintenance operation in the current switching period, because the maintenance operation will be conducted in the next or subsequent switching period in which the switching of the receiver medium supporter 40 is conducted. On the other hand, when the subtracted number is smaller than the planned receiver number of sheets, the maintenance determining unit 130 determines that the maintenance operation is executed in the current switching period.

Now, the operation of the printer 1 of the present embodiment will be described with reference to FIG. 7. The steps D1 to D5 are not described here because they are substantially identical with the steps A1 to A5 above.

In the step D6, the switching control unit 133 determines whether the switching of the receiver medium supporter 40 is necessary, based on whether the detection unit 126 has detected that the number of sheets P placeable on the receiver medium supporter 40 is zero. When it is unnecessary to switch the receiver medium supporter 40 (D6: NO), whether the switching of the sender medium storage 30 is necessary is determined based on whether the detection unit 126 has detected that the number of sheets P stored in the sender medium storage 30 is zero (D7).

When it is unnecessary to switch the sender medium storage 30 (D7: NO), the process proceeds to the step D10. On the other hand, when it is necessary to switch the sender medium storage 30 (D7: YES), the switching control unit 133 controls the recording unit 10, the upstream conveyance mechanism 50, and the downstream conveyance mechanism 60 via the image recording control unit 121 so as to stop the image recording operation (D8). Thereafter, the switching control unit 133 conducts the switching of the sender medium storage 30 (D9), and the process proceeds to the step D10. The steps D10 to D12 are not described here because they are substantially identical with the steps C10 to C12 above.

If in the step D6 the switching control unit 133 has determined that the switching of the receiver medium supporter 40 is necessary (D6: YES), the switching control unit 133 controls the recording unit 10, the upstream conveyance mechanism 50, and the downstream conveyance mechanism 60 via the image recording control unit 121 so as to stop the image recording operation (D13). Thereafter, the maintenance determining unit 130 determines at the start of the switching period whether a subtracted number calculated by subtracting the number of sheets P counted by the counter 129 from the maintenance requiring number is smaller than the required recording number calculated by the calculator 127 (D14). When the subtracted number is larger than the required recording number (D14: NO), the maintenance operation is not executed in the switching period and the process proceeds to the step D16.

On the other hand, when the subtracted number is smaller than the required recording number (D14: YES), the maintenance determining unit 130 determines whether the subtracted number is smaller than the planned receiver number of sheets placeable on a medium supporter 40 which is detected by the detection unit 126 to function as a receiver medium supporter 40 after the switching period of switching the receiver medium supporter 40 (D15). When the subtracted number is not smaller than the planned receiver number (D15: NO), the maintenance determining unit 130 determines that the maintenance operation is not executed in the switching period, and the process proceeds to the step D16. On the other hand, when the subtracted number is smaller than the planned receiver number (D15: YES), the maintenance determining unit 130 determines that the maintenance operation is executed in the switching period, and the process proceeds to the step D17.

In the step D16, the switching control unit 133 conducts the switching of the receiver medium supporter 40. After the step D16, the process proceeds to the step D3 to resume the image recording operation. In the step D17, the switching control unit 133 executes an operation substantially identical with the operation in the step D16 above. During the switching period of switching the receiver medium supporter 40 by the switching control unit 133, the maintenance controller 131 executes a maintenance operation similar to the operation in the step A13 above. After the step D17, the process goes back to the step D3 to resume the image recording operation. The printer 1 operates in this way.

As described above, according to the present embodiment, the frequency and duration of stopping the image recording operation are reduced because the maintenance operation is executed during the switching period in which the receiver medium supporter 40 is switched. The user waiting time is therefore reduced.

It is noted that First Embodiment and Second Embodiment described above may be combined. That is to say, in the maintenance period, the switching of the sender medium storage 30 and the switching of the receiver medium supporter 40 may be performed.

In addition to the above, Third Embodiment may be combined with Fourth Embodiment. That is to say, the maintenance operation may be executed in the switching period in which the switching of the sender medium storage 30 is conducted and in the switching period in which the switching of the receiver medium supporter 40 is conducted. In this case, when, for example, whether the maintenance operation is executed during the switching period of switching the sender medium storage 30 is determined, if the subtracted number is smaller than the required recording number, the maintenance determining unit 130 preferably determines that the maintenance operation is conducted in the current switching period only when the subtracted number is smaller than both the planned sender number of sheets P detected by the detection unit 126 in a medium storage 30 which functions as a sender medium storage 30 after the switching period of switching the sender medium storage 30 and the number of sheets P placeable on the medium supporter 40 which is currently selected as the receiver.

Figure 8:
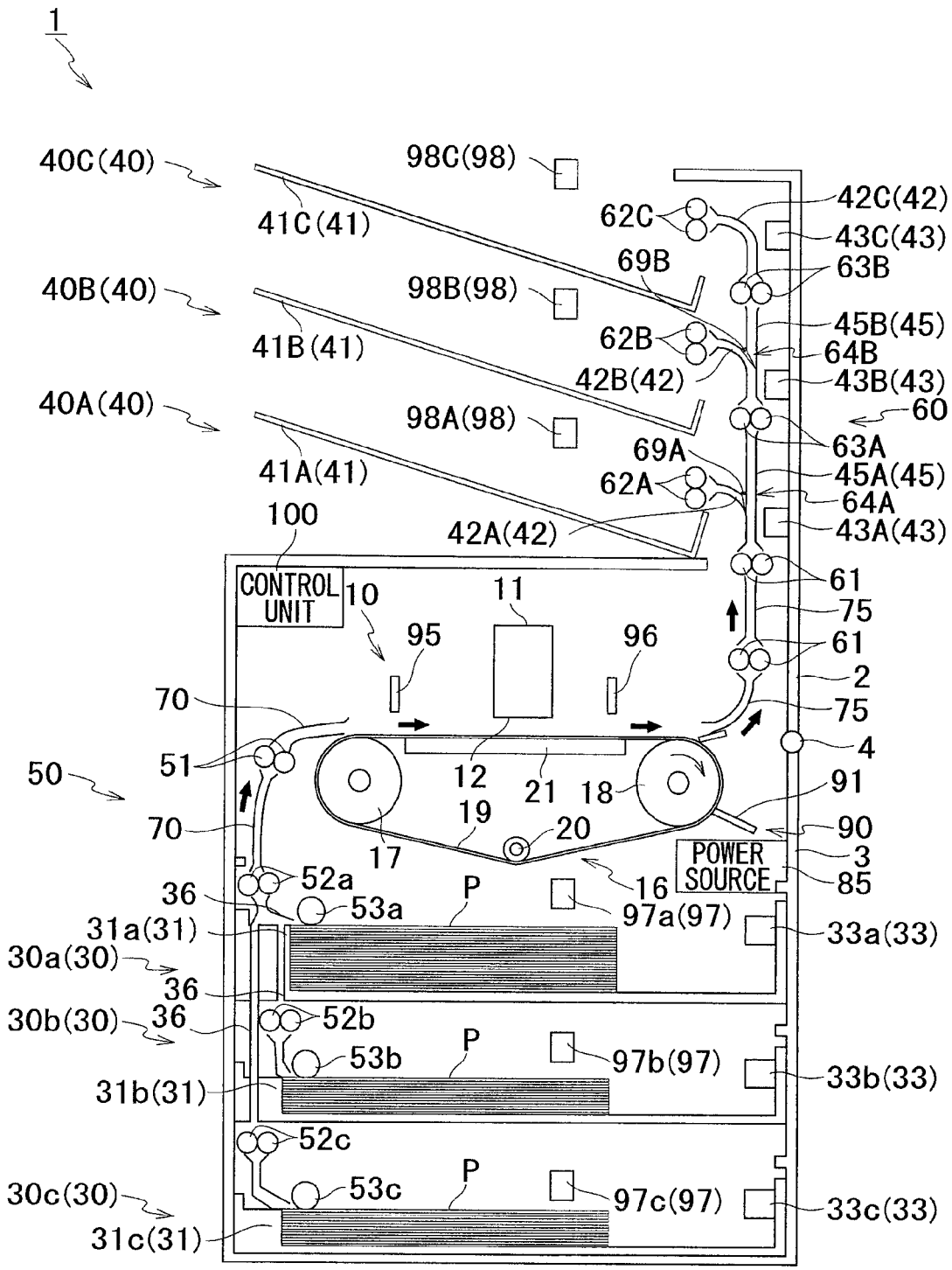
FIG. 8 is a schematic profile showing the mechanical structure of an inkjet printer of a variation.

In addition to the above, while in the embodiment above the medium storages 30 are connected to the recording unit 10 in multiple stages, the disclosure is not limited to this arrangement. For example, as shown in FIG. 8, an individual conveying path 36 is formed between each medium storage 30 and the recording unit 10, and sheets P stored in each medium storage 30 are directly conveyed to the recording unit 10 without passing through the conveying path of another medium storage 30. In such a case, the power selection supply unit 125 controls the power source 85 so that the power is supplied to only the sender medium storage 30 among the medium storages 30. The power saving is achieved because it is unnecessary to supply the power to the medium storages 30 other than the sender medium storage 30. Furthermore, while in the embodiment above the medium supporters 40 are connected to the recording unit 10 in multiple stages, the disclosure is not limited to this arrangement. For example, an individual conveying path is formed between each medium supporter 40 and the recording unit 10, and sheets P on which images have been recorded by the recording unit 10 are directly conveyed to the receiver medium supporter 40 without passing through another medium supporter 40.

In addition to the above, the maintenance determining unit 130 may determine that the maintenance operation is necessary when a maintenance instruction is made by the user through the touch panel 81. The maintenance mechanism is not limited to the mechanism recited in the embodiments above, and may be variously arranged on condition that the maintenance of the recording unit 10 is done. Furthermore, the image recording apparatus is not limited to the inkjet printer, and may be embodied as other apparatuses conducting image recording, e.g., a facsimile machine or a photocopier.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image recording apparatus comprising:

a storage unit configured to store image data;

a recording unit configured to record an image on a recording medium in accordance with the image data;

a plurality of medium storages configured to store same-sized recording media;

a conveyance mechanism configured to selectively convey the recording media stored in the medium storages to the recording unit;

a sensor configured to detect the number of recording media stored in each of the medium storages;

a maintenance mechanism configured to perform maintenance of the recording unit; and a control device configured to perform:

a detection process of detecting the number of recording media stored in at least two of the medium storages based on a result of detection by the sensor;

a calculation process of calculating the number of recording media required to record all remaining images on recording media by the recording unit in accordance with the image data;

a determination process of determining whether the maintenance of the recording unit is necessary;

an image recording process of controlling the conveyance mechanism so that the recording media are conveyed from a sender medium storage which is one of the medium storages and controlling the recording unit so that images in accordance with the image data are recorded on the recording media conveyed to the recording unit by the conveyance mechanism;

a maintenance process of controlling the maintenance mechanism so that the maintenance of the recording unit is performed when it is determined in the determination process that the maintenance of the recording unit is necessary; and a switching process of controlling the conveyance mechanism and the recording unit so that the conveyance of the recording media from the sender medium storage to the recording unit and recording of images onto the recording media are not conducted during a maintenance period in which the maintenance of the recording unit is performed by the maintenance mechanism, and, when, at the start of the maintenance period, the number of recording media stored in the sender medium storage detected in the detection process is smaller than the number of recording media calculated in the calculation process and, among the medium storages, there is at least one predetermined remaining number medium storage which is a medium storage storing more recording media than the sender medium storage, controlling the conveyance mechanism to select one of the at least one predetermined remaining number medium storage as the sender medium storage, during the maintenance period.

2. The image recording apparatus according to claim 1, wherein, the control device controls the conveyance mechanism so that, among the at least one predetermined remaining number medium storage, a predetermined remaining number medium storage in which the number of recording media detected in the detection process is not smaller than the number of recording media calculated in the calculation process is selected as the sender medium storage.

3. The image recording apparatus according to claim 1, further comprising:

a selective power supply device configured to selectively supply power to each of the medium storages, the control device further executing a selective power supply process of controlling the selective power supply device so that the power is supplied to only the sender medium storage among the medium storages.

4. The image recording apparatus according to claim 1, further comprising:

a selective power supply device configured to selectively supply power to each of the medium storages, the medium storages being serially connected to the recording unit in multiple stages, when a medium storage which is on a second or subsequent stage from the recording unit is selected as the sender medium storage, the conveyance mechanism conveying the recording media to the recording unit via a medium storage on a stage preceding to the sender medium storage, and the control device further executing a selective power supply process of controlling the selective power supply device so that the power is supplied to only the sender medium storage and the medium storage on the stage preceding to the sender medium storage.

5. The image recording apparatus according to claim 1, wherein, in the detection process, the number of recording media stored in each of the medium storages is detected based on a result of detection by the sensor, and when the sender medium storage is switched, the control device controls the conveyance mechanism based on a result of detection in the detection process so that a medium storage storing the largest number of recording media is selected as a new sender medium storage.

6. An image recording apparatus comprising:

a storage unit configured to store image data;

a recording unit configured to record an image on a recording medium in accordance with the image data;

a plurality of medium storages configured to store same-sized recording media;

a conveyance mechanism configured to selectively convey the recording media stored in the medium storages to the recording unit;

a sensor configured to detect the number of recording media stored in each of the medium storages;

a maintenance mechanism configured to perform maintenance of the recording unit; and a control device configured to perform:

a detection process of detecting the number of recording media stored in at least two of the medium storages, based on a result of detection by the sensor;

a counting process of counting the number of recording media on which images have been recorded by the recording unit in accordance with the image data, from a later one of a timing at which the recording of the images onto the recording media by the recording unit in accordance with the image data starts and a timing at which previous maintenance is performed by the maintenance mechanism;

a calculation process of calculating the number of recording media required to record all remaining images on recording media by the recording unit in accordance with the image data;

an image recording process of controlling the conveyance mechanism so that recording media are conveyed from a sender medium storage which is one of the medium storages and controls the recording unit so that images are recorded on the recording media conveyed by the conveyance mechanism in accordance with the image data;

a maintenance process of controlling the maintenance mechanism so that maintenance of the recording unit is performed when the number of recording media counted in the counting process reaches a predetermined number; and a switching process of controlling the conveyance mechanism so that, when it is determined in the detection process that the number of recording media stored in the sender medium storage is zero, the sender medium storage is switched to one of medium storages in each of which the number of stored recording media is not zero, in a switching period in which the sender medium storage is switched by the conveyance mechanism, the conveyance mechanism and the recording unit being controlled so that the conveyance of recording media from the medium storage to the recording unit and recording of images onto the recording media are not performed, and when a number calculated by subtracting the number of recording media counted in the counting process from the predetermined number is smaller than the number of recording media calculated in the calculation process and the number of recording media detected in the detection process stored in a medium storage which is selected to function as the sender medium storage after the switching period of switching the sender medium storage, the maintenance mechanism is controlled so that the maintenance of the recording unit is performed in the switching period.

7. A non-transitory computer readable medium configured to store a program performed by an image recording apparatus including: a storage unit configured to store image data; a recording unit configured to record an image on a recording medium in accordance with the image data; a plurality of medium storages configured to store same-sized recording media; a conveyance mechanism configured to selectively convey the recording media stored in the medium storages to the recording unit; a sensor configured to detect the number of recording media stored in each of the medium storages; and a maintenance mechanism configured to perform maintenance of the recording unit, the program causing the image recording apparatus to perform:

a detection process of detecting the number of recording media stored in at least two of the medium storages based on a result of detection by the sensor;

a calculation process of calculating the number of recording media required to record all remaining images on recording media by the recording unit in accordance with the image data;

a determination process of determining whether the maintenance of the recording unit is necessary;

an image recording process of controlling the conveyance mechanism so that the recording media are conveyed from a sender medium storage which is one of the medium storages and controlling the recording unit so that images in accordance with the image data are recorded on the recording media conveyed to the recording unit by the conveyance mechanism;

a maintenance process of controlling the maintenance mechanism so that the maintenance of the recording unit is performed when it is determined in the determination process that the maintenance of the recording unit is necessary; and a switching process of controlling the conveyance mechanism and the recording unit so that the conveyance of the recording media from the sender medium storage to the recording unit and recording of images onto the recording media are not conducted during a maintenance period in which the maintenance of the recording unit is performed by the maintenance mechanism, and, when, at the start of the maintenance period, the number of recording media stored in the sender medium storage detected in the detection process is smaller than the number of recording media calculated in the calculation process and, among the medium storages, there is at least one predetermined remaining number medium storage which is a medium storage storing more recording media than the sender medium storage, controlling the conveyance mechanism to select one of the at least one of predetermined remaining number medium storage as the sender medium storage, during the maintenance period.

8. A non-transitory computer readable medium configured to store a program performed by an image recording apparatus including: a storage unit configured to store image data; a recording unit configured to record an image on a recording medium in accordance with the image data; a plurality of medium storages configured to store same-sized recording media; a conveyance mechanism configured to selectively convey the recording media stored in the medium storages to the recording unit; a sensor configured to detect the number of recording media stored in each of the medium storages; and a maintenance mechanism configured to perform maintenance of the recording unit, the program causing the image recording apparatus to perform:

a detection process of detecting the number of recording media stored in at least two of the medium storages, based on a result of detection by the sensor;

a counting process of counting the number of recording media on which images have been recorded by the recording unit in accordance with the image data, from a later one of a timing at which the recording of the images onto the recording media by the recording unit in accordance with the image data starts and a timing at which previous maintenance is performed by the maintenance mechanism;

a calculation process of calculating the number of recording media required to record all remaining images on recording media by the recording unit in accordance with the image data;

an image recording process of controlling the conveyance mechanism so that recording media are conveyed from a sender medium storage which is one of the medium storages and controls the recording unit so that images are recorded on the recording media conveyed by the conveyance mechanism in accordance with the image data;

a maintenance process of controlling the maintenance mechanism so that maintenance of the recording unit is performed when the number of recording media counted in the counting process reaches a predetermined number; and a switching process of controlling the conveyance mechanism so that, when it is determined in the detection process that the number of recording media stored in the sender medium storage is zero, the sender medium storage is switched to one of medium storages in each of which the number of stored recording media is not zero, in a switching period in which the sender medium storage is switched by the conveyance mechanism, the conveyance mechanism and the recording unit being controlled so that the conveyance of recording media from the medium storage to the recording unit and recording of images onto the recording media are not performed, and when a number calculated by subtracting the number of recording media counted in the counting process from the predetermined number is smaller than the number of recording media calculated in the calculation process and the number of recording media detected in the detection process stored in a medium storage which is selected to function as the sender medium storage after the switching period of switching the sender medium storage, the maintenance mechanism is controlled so that the maintenance of the recording unit is performed in the switching period.

* * * * *